US012523414B2

(12) United States Patent
Maluto et al.

(10) Patent No.: US 12,523,414 B2
(45) Date of Patent: Jan. 13, 2026

(54) DISPLAY CASE DOOR WITH BARRIER BETWEEN GLASS PANEL AND ELECTRONIC DISPLAY

(71) Applicant: Anthony, Inc., Sylmar, CA (US)

(72) Inventors: Dexter Maluto, Los Angeles, CA (US); Richard Alcala, Palmdale, CA (US); Pedro Almaguer, North Hills, CA (US); Mark Sandnes, Granada Hills, CA (US)

(73) Assignee: Anthony, Inc., Sylmar (CA)

( * ) Notice: Subject to any disclaimer, the term of this patent is extended or adjusted under 35 U.S.C. 154(b) by 617 days.

(21) Appl. No.: 17/748,840

(22) Filed: May 19, 2022

(65) Prior Publication Data

US 2023/0375250 A1 Nov. 23, 2023

(51) Int. Cl.
*F25D 23/02* (2006.01)

(52) U.S. Cl.
CPC ..... *F25D 23/028* (2013.01); *F25D 2400/36* (2013.01)

(58) Field of Classification Search
CPC ..... F25D 23/028; F25D 2400/36; G09F 2023/0033; G09F 9/30; G09F 23/0058; G09F 23/06; A47F 3/0434
See application file for complete search history.

(56) References Cited

U.S. PATENT DOCUMENTS 5,418,055 A 5/1995 Chen et al.
9,535,293 B2 1/2017 Dunn
10,670,329 B2 * 6/2020 Kang et al. ..... F25D 11/00
11,650,628 B1 5/2023 Nicholson et al.
2016/0123654 A1 5/2016 Lee et al.
2016/0153221 A1 6/2016 Dodge et al.
2016/0178277 A1 * 6/2016 Park ..... F25D 23/028 345/173
2017/0119176 A1 5/2017 Christiansen et al.
2017/0360221 A1 * 12/2017 Rolek et al. ..... A47F 3/0434
(Continued)

FOREIGN PATENT DOCUMENTS

CA 3013728 2/2019
WO WO 2019/032893 2/2019
(Continued)

OTHER PUBLICATIONS

[No Author Listed], ".093/(2.36) Housings, Plug and Receptacle, 12 CKT, 198/(5.03)CTR," Molex, Nov. 13, 2014, 2 pages.
(Continued)

*Primary Examiner* — Jerry-Daryl Fletcher
*Assistant Examiner* — Dario Antonio Deleon
(74) *Attorney, Agent, or Firm* — Fish & Richardson P.C.

(57) ABSTRACT

A display case door includes an insulated panel assembly, a door frame, an electronic display assembly, and one or more thermal barriers. The insulated panel assembly includes one or more panes and defines a front and a rear. The door frame is coupled to the insulated panel assembly. The electronic display assembly is coupled to the door frame in front of the insulated panel assembly. The electronic display assembly includes a rear surface. The one or more thermal barriers are disposed between the rear surface of the electronic display assembly and a front surface of one of the one or more panes of the insulated panel assembly.

28 Claims, 18 Drawing Sheets

(56) References Cited

U.S. PATENT DOCUMENTS

| | | | | |
|---|---|---|---|---|
| 2019/0050900 | A1 | 2/2019 | Avakian | |
| 2019/0122263 | A1 | 4/2019 | Avakian | |
| 2019/0208925 | A1* | 7/2019 | Kim et al. | F25D 23/06 |
| 2019/0221144 | A1* | 7/2019 | Nicholson et al. | A47F 3/0434 |
| 2020/0256612 | A1 | 8/2020 | Avakian et al. | |
| 2020/0300538 | A1 | 9/2020 | Avakian et al. | |
| 2021/0041161 | A1 | 2/2021 | Avakian | |
| 2021/0366005 | A1 | 11/2021 | Avakian et al. | |
| 2022/0146184 | A1* | 5/2022 | Motoi et al. | F25D 23/02 |
| 2023/0180948 | A1 | 6/2023 | Almaguer et al. | |
| 2023/0225065 | A1 | 7/2023 | Sandnes et al. | |

FOREIGN PATENT DOCUMENTS

| | | |
|---|---|---|
| WO | WO 2020/131881 | 6/2020 |
| WO | WO 2021/150406 | 7/2021 |

OTHER PUBLICATIONS

Invitation to Pay Additional Fees in International Appln. No. PCT/US2023/022760, dated Jul. 26, 2023, 2 pages.
International Search Report and Written Opinion in International Appln. No. PCT/US2023/022760, dated Sep. 29, 2023, 16 pages.

* cited by examiner

DISPLAY CASE DOOR WITH BARRIER BETWEEN GLASS PANEL AND ELECTRONIC DISPLAY

TECHNICAL FIELD

This invention relates to thermally insulated doors for temperature-controlled enclosures.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more thermally insulated doors or windows for viewing and accessing refrigerated or frozen objects within a temperature-controlled space. Doors for refrigerated enclosures generally include thermally insulated glass panel assemblies.

SUMMARY

The present disclosure relates to a display case door for a refrigerated enclosure.

In a general aspect, a display case door includes an insulated panel assembly, a door frame, an electronic display assembly, and one or more thermal barriers. The insulated panel assembly includes one or more panes and defines a front and a rear. The door frame is coupled to the insulated panel assembly. The electronic display assembly is coupled to the door frame in front of the insulated panel assembly. The electronic display assembly includes a rear surface. The one or more thermal barriers are disposed between the rear surface of the electronic display assembly and a front surface of one of the one or more panes of the insulated panel assembly.

In some implementations, at least one of the thermal barriers is configured to inhibit heat transfer from one or more heat producing components of the electronic display assembly to the one or more panes of the insulated panel assembly.

In some implementations, at least one of the thermal barriers contacts at least a portion of a front surface of the insulated panel assembly and at least a portion of a rear surface of the electronic display assembly.

In some implementations, at least one of the one or more thermal barriers is held in place between at least a portion of the front surface of the pane and at least a portion of the rear surface of the electronic display assembly.

In some implementations, the rear surface of the electronic display assembly defines one or more contours, a front surface at least one of the thermal barriers defines one or more contours, and the front surface of the thermal barrier is configured to at least partially conform to at least a portion of the rear surface of the electronic display assembly.

In some implementations, at least one of the thermal barriers includes a resilient material, and at least a portion of the thermal barrier is in compression between the rear surface of the electronic display and the front surface of the insulated panel assembly.

In some implementations, at least one of the thermal barriers includes a foam.

In some implementations, at least one of the thermal barriers includes ethyl vinyl acetate (EVA).

In some implementations, at least one of the thermal barriers includes an inner layer and at least one outer layer. The inner layer includes a resilient material.

In some implementations, at least one of the thermal barriers includes an inner layer and at least one outer layer. The inner layer includes an ethyl vinyl acetate (EVA), and the outer layer includes a polyethylene.

In some implementations, the display case door further includes an adhesive material configured to secure at least one of the one or more thermal barriers to one of the panes of the insulated panel assembly.

In some implementations, at least a portion of the rear surface of at least one of the one or more thermal barriers includes an information display.

In some implementations, the insulated panel assembly includes two or more rails. The display case door further includes a thermally conductive material on a front surface of at least one of the rails.

In some implementations, at least a portion of at least one of the one or more panes of the insulated panel assembly includes a heat-reflective coating.

In some implementations, at least one of the one or more thermal barriers includes two or more portions, a first one of the portions of the at least one thermal barrier inhibits heat transfer from a first heat producing component of the electronic display assembly to the one or more panes of the insulated panel assembly, and a second one of the portions of the at least one thermal barrier inhibits heat transfer from a second heat producing component of the electronic display assembly to the one or more panes of the insulated panel assembly.

In some implementations, an outer edge of at least one of the thermal barriers defines an air gap between the thermal barrier and at least one rail of the door frame.

In some implementations, at least a portion of at least one of the thermal barriers contacts at least one of rail of the door frame.

In some implementations, at least one of the one or more thermal barriers is configured to conceal at least a portion of the rear surface of the electronic display assembly from a user looking through the one or more panes from the rear of the insulated panel assembly.

In some implementations, one or more covers configured to conceal at least a portion of the rear surface of the electronic display assembly from a user looking through the one or more panes from the rear of the insulated panel assembly.

In a general aspect, a thermal barrier for an insulated panel assembly of a display case door, includes: a thermally insulating portion, a rear surface configured to couple with a front surface of a pane of an insulated panel assembly, and a front surface configured to couple with a rear surface of an electronic display assembly.

In some implementations, the front surface includes one or more contours configured to at least partially conform to a rear surface of the electronic display assembly.

In some implementations, the front surface is pre-molded to at least partially conform to a rear surface of the electronic display assembly.

In some implementations, the thermally insulating portion includes a resilient material configured to conform to one or more contours on the rear surface of the electronic display assembly.

In some implementations, including an adhesive configured to couple the thermally insulating portion to at least one of a pane of the insulated panel assembly.

In some implementations, the thermally insulating portion includes a foam.

In a general aspect, a method of protecting an insulated panel assembly in a display case door from thermal damage includes: positioning a thermal barrier on or adjacent to at least one of a front surface of one of the panes of the insulated panel assembly and a rear surface of an electronic display assembly to be installed in front of the insulated panel assembly, and positioning the electronic display assembly relative to the electronic display assembly such that the thermal barrier is between a front surface of one of the panes of the insulated panel assembly and a rear surface of an electronic display assembly and such that the thermal barrier inhibits transfer of heat from heat producing components in the electronic display assembly.

In some implementations, positioning the thermal barrier includes installing the thermal barrier in a space between the front surface of the insulated panel assembly and the rear surface of the electronic display assembly.

In some implementations, positioning the electronic display assembly includes mounting the electronic display assembly on a door frame holding the insulated panel assembly.

In some implementations, positioning the electronic display includes swinging on a hinge of a door frame holding the insulated panel assembly such that the electronic display assembly is in front of the insulated panel assembly.

In some implementations, positioning the thermal barrier between the front surface of one of the panes of the insulated panel assembly and the rear surface of the electronic display assembly includes attaching the thermal barrier to the front surface of the pane.

In some implementations, the method further includes positioning the thermal barrier between the front surface of one of the panes of the insulated panel assembly and the rear surface of the electronic display assembly includes attaching the thermal barrier to the rear surface of the electronic display assembly.

In some implementations, the thermal barrier is held between the pane of the insulated panel assembly and the electronic display assembly.

In some implementations, at least a portion of the thermal barrier is compressed between the pane of the insulated panel assembly and the electronic display assembly.

In some implementations, at least a portion of the rear surface of the electronic display assembly and at least a portion of a front surface of the thermal barrier are complementary to one another.

In some implementations, the method further includes coupling complementary surfaces of the thermal barrier and the electronic display assembly.

In a general aspect, a display case door includes an insulated panel assembly, a door frame, an electronic display assembly, and one or more covers. The insulated panel assembly includes one or more panes. The insulated panel assembly defines a front and a rear. The door frame includes two or more rails coupled to the insulated panel assembly. The electronic display assembly is coupled to the door frame in front of the insulated panel assembly. The electronic display assembly includes a rear surface. The one or more covers are attached to a front surface of one pane of the one or more panes. At least one of the one or more covers is configured to conceal at least a portion of the rear surface of the electronic display assembly from a user looking through the one or more panes from the rear of the insulated panel assembly.

In some implementations, the cover is self-attaching to the front surface of the pane.

In some implementations, the cover includes a static cling film.

In some implementations, the cover includes an adhesive.

In some implementations, the cover is removable from the front surface of the pane.

In some implementations, the cover is re-attachable to the front surface of the pane.

In some implementations, the cover includes one or more apertures configured to allow one or more sensors of the electronic display assembly to sense objects to the rear of the insulated panel assembly.

In some implementations, the cover includes one or more apertures, wherein a location at least one of the one or more apertures corresponds to one or more sensors on the rear surface of the electronic display assembly.

In some implementations, a rear surface of the cover includes an information display.

In some implementations, the electronic display assembly is configured to swing out with respect to the insulated panel assembly.

In a general aspect, a display case door includes an insulated panel assembly, a door frame, an electronic display assembly, and one or more visual barriers. The insulated panel assembly includes one or more panes, the insulated panel assembly defining a front and a rear. The door frame includes two or more rails coupled to the insulated panel assembly. The electronic display assembly is coupled to the door frame in front of the insulated panel assembly. The electronic display assembly includes a rear surface. The one or more visual barriers are disposed between a front surface of one of the one or more panes and the rear surface of the electronic display assembly.

In some implementations, at least one of the one or more visual barriers is configured to conceal at least a portion of the rear surface of the electronic display assembly from a user looking through the one or more panes from the rear of the insulated panel assembly.

In some implementations, the visual barrier is removable.

In some implementations, the visual barrier includes a static cling film.

In some implementations, the display case door further includes one or more coupling members configured to couple the visual barrier to the insulated panel assembly.

In some implementations, the visual barrier includes one or more apertures configured to allow one or more sensors of the electronic display assembly to sense objects to the rear of the insulated panel assembly.

In a general aspect, a cover includes a sheet. The sheet is configured to attach to a surface of a pane of an insulated panel assembly. The sheet includes a front surface and a rear surface. The sheet defines one or more apertures configured to allow one or more sensors in front of the insulated panel assembly to sense objects to the rear of the insulated panel assembly.

In some implementations, the sheet is configured to self-attach to the surface of the pane.

In some implementations, the sheet is configured to electrostatically cling to the surface of the pane.

In some implementations, the sheet includes a static cling film.

In a general aspect, a method includes: attaching a cover to at least a portion of on a front surface of a pane of an insulated panel assembly, and positioning an electronic display assembly such that at least a portion of the cover at least partially conceals a rear surface of the electronic display assembly from view of a user looking through the pane of the insulated panel assembly.

In some implementations, the method includes attaching the cover includes pressing the cover against the pane such that the cover clings to at least a portion of the pane.

In some implementations, the method includes removing the cover.

In some implementations, the method includes removing the cover, and re-attaching the cover.

In some implementations the cover defines one or more apertures that align with one or more sensors to allow the one or more sensors to detect data on the rear of the insulated panel assembly.

In a general aspect, a method includes: positioning a visual barrier in front of a transparent pane of an insulated panel assembly; positioning an electronic display assembly such that: at least a portion of the visual barrier is between a front surface of the transparent pane and a rear surface of the electronic display assembly, and the visual barrier at least partially conceals a rear surface of the electronic display assembly from view of a user looking through the transparent pane of the insulated panel assembly.

Particular implementations of the subject matter described in this specification can be implemented so as to realize one or more of the following advantages.

Implementations of the present disclosure may reduce a risk of damage to glass of an insulated panel assembly due to heat from an electronic display or other heat producing components installed on a display case door. For example, implementations may prevent glass panes of a sealed glass unit from bowing due to thermal gradients in the glass.

Implementations of the present disclosure may reduce a risk of compromised performance of an insulated panel assembly (e.g., leakage or less effective cooling in the display case) due to heat from an electronic display or other heat producing components installed on a display case door.

Implementations of the present disclosure may improve aesthetics of a display case door. For example, a user may avoid seeing aesthetically unpleasing portions of an electronic display, such as unenclosed components or wires.

Implementations of the present disclosure may allow users to receive useful or pertinent information when accessing the contents of a display case.

Implementations of the present disclosure may improve the maintainability of electronic displays mounted to a display case door. For example, implementations of the present disclosure may provide for easy replacement or maintenance of SGU assemblies.

Implementations of the present disclosure may reduce handling costs and simplify logistics.

Implementations of the present disclosure may simplify display case door removal and increase the safety of the operation.

Implementations of the present disclosure may reduce a risk of condensation on a display case door.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
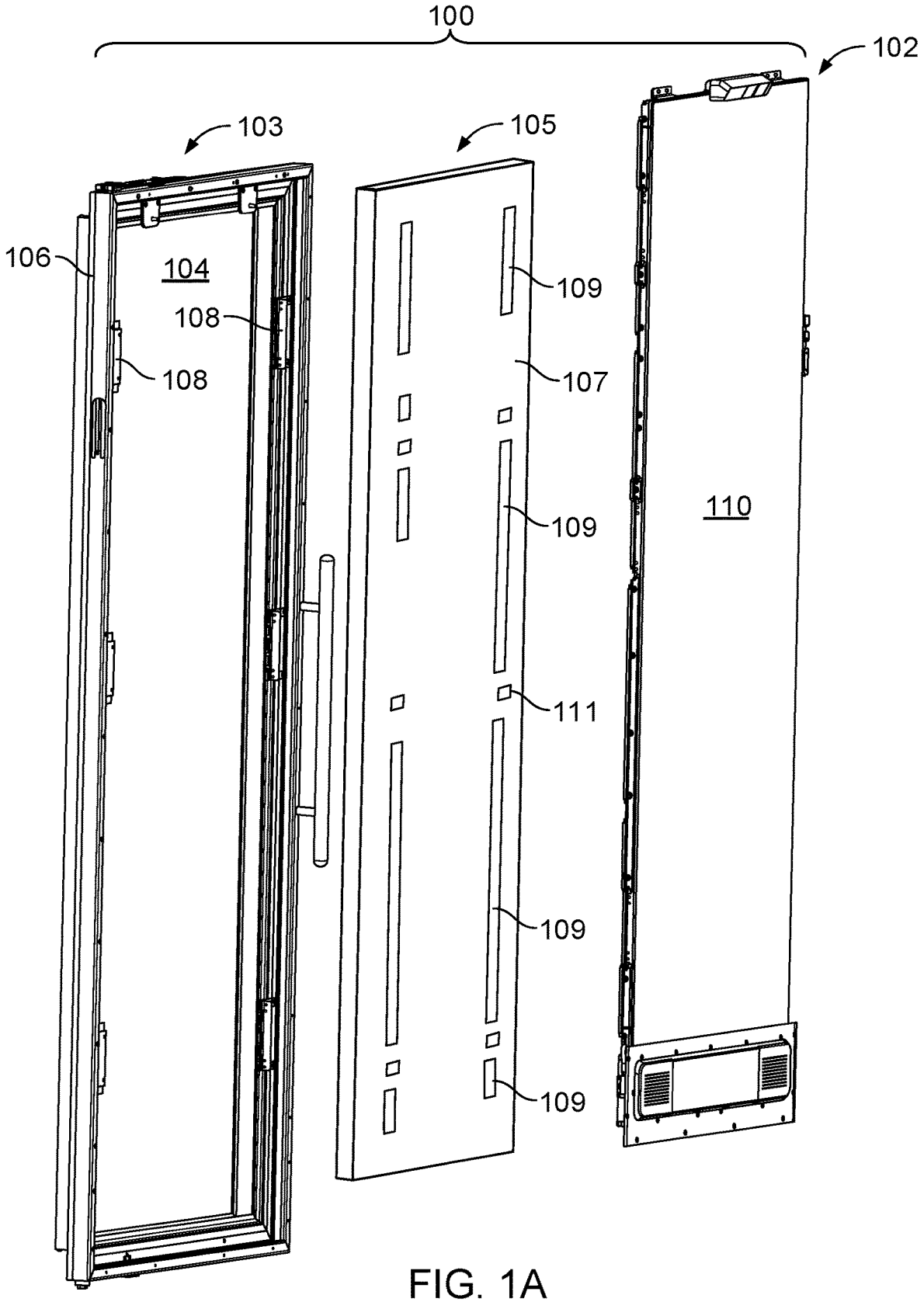
FIGS. 1A and 1B are exploded perspective views of an exemplary electronic display case door according to some implementations of the present disclosure.
Figure 1B:
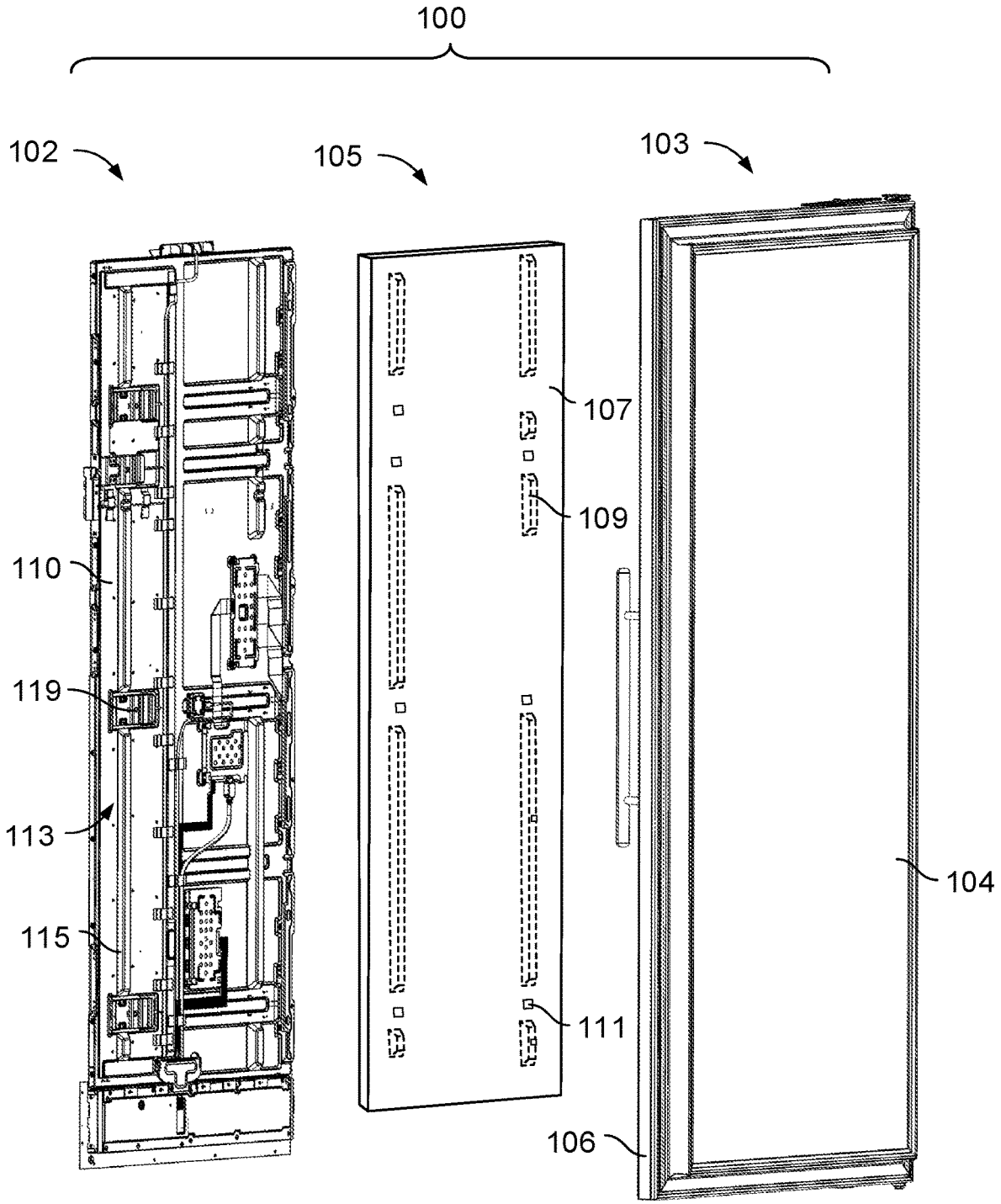

FIGS. 1A and 1B are exploded perspective views of an exemplary arrangement of an electronic display assembly 102 in a display case door 100 according to implementations of the present disclosure. FIGS. 1A and 1B illustrates an exemplary display case door 100 that can be installed in a refrigerated display case such as a refrigerator, a freezer, or other enclosure defining a temperature-controlled space. FIG. 1A is an exploded perspective front view of display case door 100. FIG. 1B is an exploded perspective rear view of display case door 100.

Display case door 100 includes an electronic display assembly 102 mounted on door assembly 103. Door assembly 103 includes an insulated panel assembly 104 (which can include one or more transparent panels) and a door frame 106 secured to an edge of insulated panel assembly 104. Thermal shield 105 is disposed between electronic display assembly 102 and insulated panel assembly 104.

Mounting blocks 108 are coupled to door frame 106. Electronic display assembly 102 is coupled to door frame 106 by way of mounting blocks 108. Electronic display assembly 102 can be mounted to door frame 106 so as to overlay all or a majority of insulated panel assembly 104. Electronic display assembly 102 includes electronic display 110.

In some implementations, a display case door includes one or more bezels (omitted from FIG. 1A for clarity). The bezels can cover all or a portion of the mounting blocks and other components for mounting the electronic display assembly 102. The bezels can create a recognized UL wireway.

Insulated panel assembly 104 can include one or more panes of glass. In some implementations, insulated panel assembly 104 includes two or more layers of transparent panes bounding a sealed space in between, forming a sealed glass unit (SGU).

In some implementations, the gap or sealed space between two or more panels can be filled with an insulating gas such as a noble gas (e.g., Argon, Krypton, etc.) which functions as a thermal insulator to reduce heat transfer through the panel. In some examples, the sealed space can be evacuated below atmospheric pressure.

Door frame 106 extends around and is secured to a peripheral edge of insulated panel assembly 104. As further described in detail below, door frame 106 defines a channel or tunnel that receives one or more power cables that provide electrical power to the electronic display assembly.

Display case door 100 can include a single electronic display or multiple electronic displays. For example, display case door 100 can include two or more electronic displays vertically stacked and together covering the insulated panel assembly 104.

Electronic display 110 can include, but is not limited to, a liquid crystal display (LCD), a light emitting diode (LED) display, an organic light emitting diode (OLED) display, a field emission display (FED), a plasma display panel (PDP), or an electroluminescent (EL) display. For example, electronic display 110 can be a smart television with streaming capabilities for receiving content over a wireless network (e.g., a Wi-Fi network). Electronic display 110 is generally opaque and, when mounted on the display case door 100 partially or completely obstructs the view through the insulated panel assembly 104. In some implementations, electronic display 110 can be a custom sized display configured to correspond with dimensions of the display case door 100. In some implementations, electronic display 110 can be a commercial off the shelf (COTS) display.

Thermal shield 105 includes barrier 107. As further described below with respect to FIGS. 7 and 8, barrier 107 can be a molded sheet of foam or other thermally insulating material. Barrier 107 defines recesses 109 and apertures 111. As illustrated in FIG. 1B, recesses 109 correspond to matching contours in the rear surface 113 of electronic display assembly 102. For example, in the electronic display assembly shown in FIG. 1B, rear surface 113 includes ridges 115.

Apertures 111 pass through barrier 107. Each of apertures 111 can provide a window through which one or more sensors 119 can sense objects on the rear of insulated panel assembly 104. In the example shown in FIGS. 1A and 1B, apertures 111 are shown as square. Apertures in a thermal shield can, however, be other shapes, including circular, rectangular, oval or irregular.

For example, the electronic display assembly 102 can include one or more sensors 119 arranged to detect data on the rear of the insulated panel assembly 104. The sensors 119 can be, e.g., optical sensors such as visible light or infrared cameras arranged to detect objects (e.g., products or customers behind the display case door 100.

Figure 2:
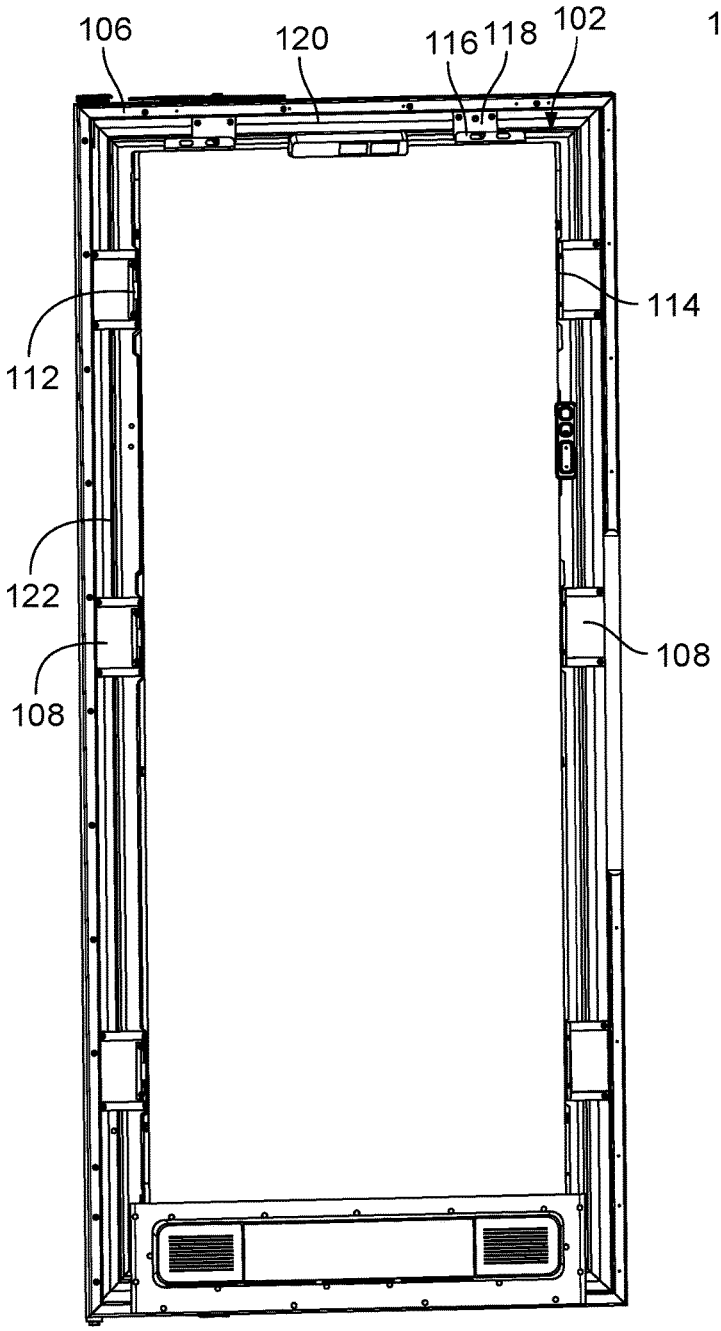
FIG. 2 is a perspective view of the electronic display case door of FIG. 1 with an electronic display mounted in a door frame.
Figure 2A:
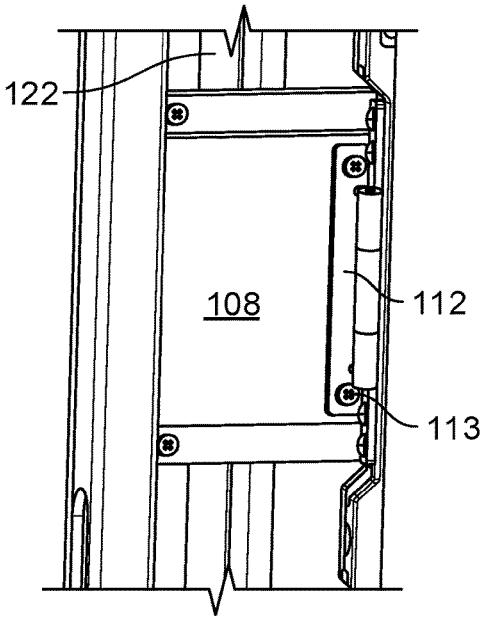
FIGS. 2A and 2B are perspective detail views illustrating mounting of the electronic display assembly.
Figure 2B:
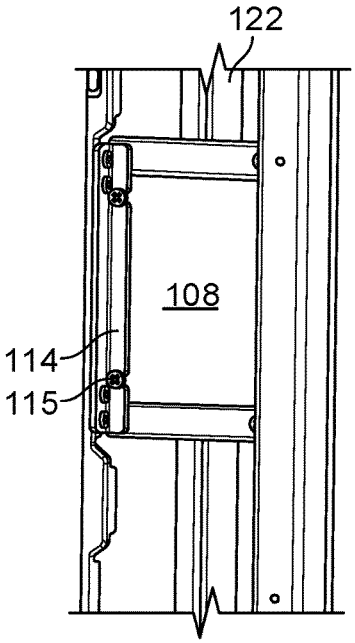

FIG. 2 is a perspective view of the electronic display case door of FIG. 1 with electronic display assembly 102 mounted in door frame 106. FIG. 2A is a perspective detail view illustrating mounting of the electronic display assembly 102 on the left side of the electronic display. FIG. 2B is a perspective detail view illustrating mounting of the electronic display assembly 102 on the right side of the electronic display.

Electronic display assembly 102 includes electronic display 110, left side hinge brackets 112, right side brackets 114, and hangers 116. Left side hinge brackets 112 are attached to electronic display 110 along the left side of electronic display 110. Right side brackets 114 are attached to electronic display 110 along the right side of electronic display 110. Each of left side hinge brackets 112 and right side brackets 114 is secured to a corresponding one of mounting blocks 108 by way of screws 121 and screws 123, respectively. Door frame 106 includes top rail 120 and side rails 122. Electronic display assembly 102 is mounted on mounting blocks 108 on the left side rail 122 of door frame 106 and mounting blocks 108 on the right side rail 122 of door frame 106. Each of hangers 116 can be coupled on a corresponding one of display supports 118.

Left side hinge bracket 112 is secured to the inside end of mounting block 108 by way of screws 113. Right side brackets 114 can be secured in a similar manner to that shown in FIGS. 6A and 6B. In one example, screws 113 used to secure left side hinge brackets 112 and screws 115 used to secure right side brackets 114 are #6 pan-head screws.

In the example shown in FIG. 2, electronic display assembly 102 includes three left side hinge brackets 112 and three right side brackets 114. In other examples, an electronic display is secured to a door frame with fewer or more than three brackets and/or corresponding mounting blocks coupled to a door frame. In one example, an electronic display is coupled by way of only one bracket and a corresponding mounting block on each side of the electronic display.

Figure 3:
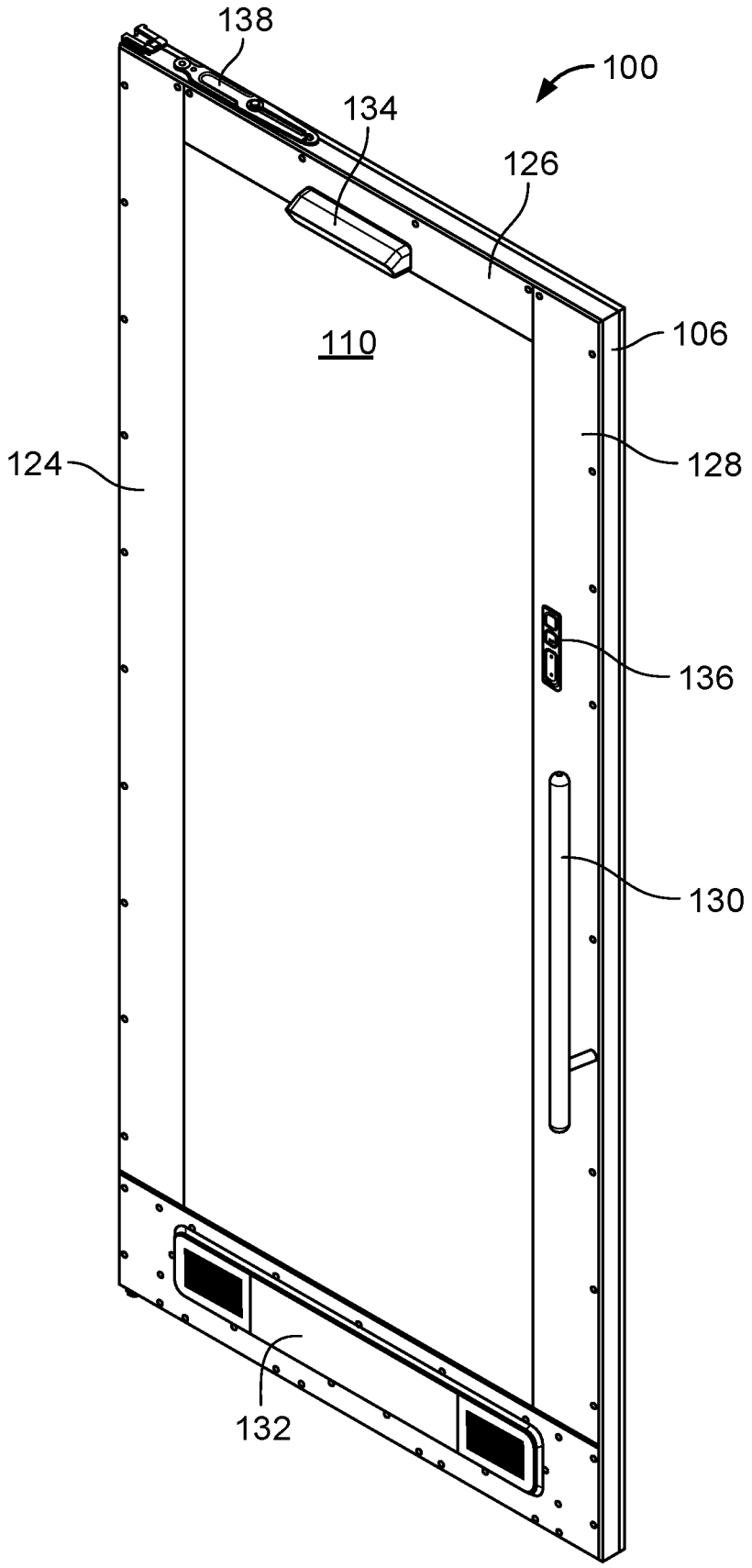
FIG. 3 is a perspective view of the electronic display case door of FIG. 1 with the electronic display assembly mounted in door frame with bezels installed.

FIG. 3 is a perspective view of the electronic display case door of FIG. 1 with electronic display assembly 102 mounted in door frame 106, with bezels installed around the edges of door frame 106. Display case door 100 includes left bezel 124, top bezel 126, and right bezel 128. Each of left bezel 124, top bezel 126, and right bezel 128 overlay and conceal a portion of mounting blocks 108, left side hinge brackets 112, right side brackets 114, hangers 116, and display supports 118.

Display case door 100 includes handle 130. Electronic display assembly 102 includes circuitry module 132, top sensor 134, and handle-side sensor 136. The outside edges of circuitry module 132 are secured to left rail 206 and right rail 208 of door frame 106. Left bezel 124 and right bezel 128 can be attached to their respective rails. Top sensor 134 passes through an opening or cutout in top bezel 126. Handle-side sensor 136 is accessible through a corresponding aperture in right bezel 128.

Hold open bracket 138 is provided on a top edge of display case door 100. One end of hold open bracket 138 is pivotally coupled to door frame 106. In service, hold open bracket 138 can be used to maintain door in a desired open position.

Circuitry module 132 is positioned in a bottom portion of door frame 106. Circuitry module 132 overlays a portion of insulated panel assembly 104. Circuitry module 132 can be attached to electronic display 110 such that, with electronic display 110 releasably coupled to door frame 106, circuitry module 132 is releasably coupled to door frame 106. Circuitry module 132 can include a media player in electronic communication with electronic display 110 to control media content presented on electronic display 110.

Figure 4:
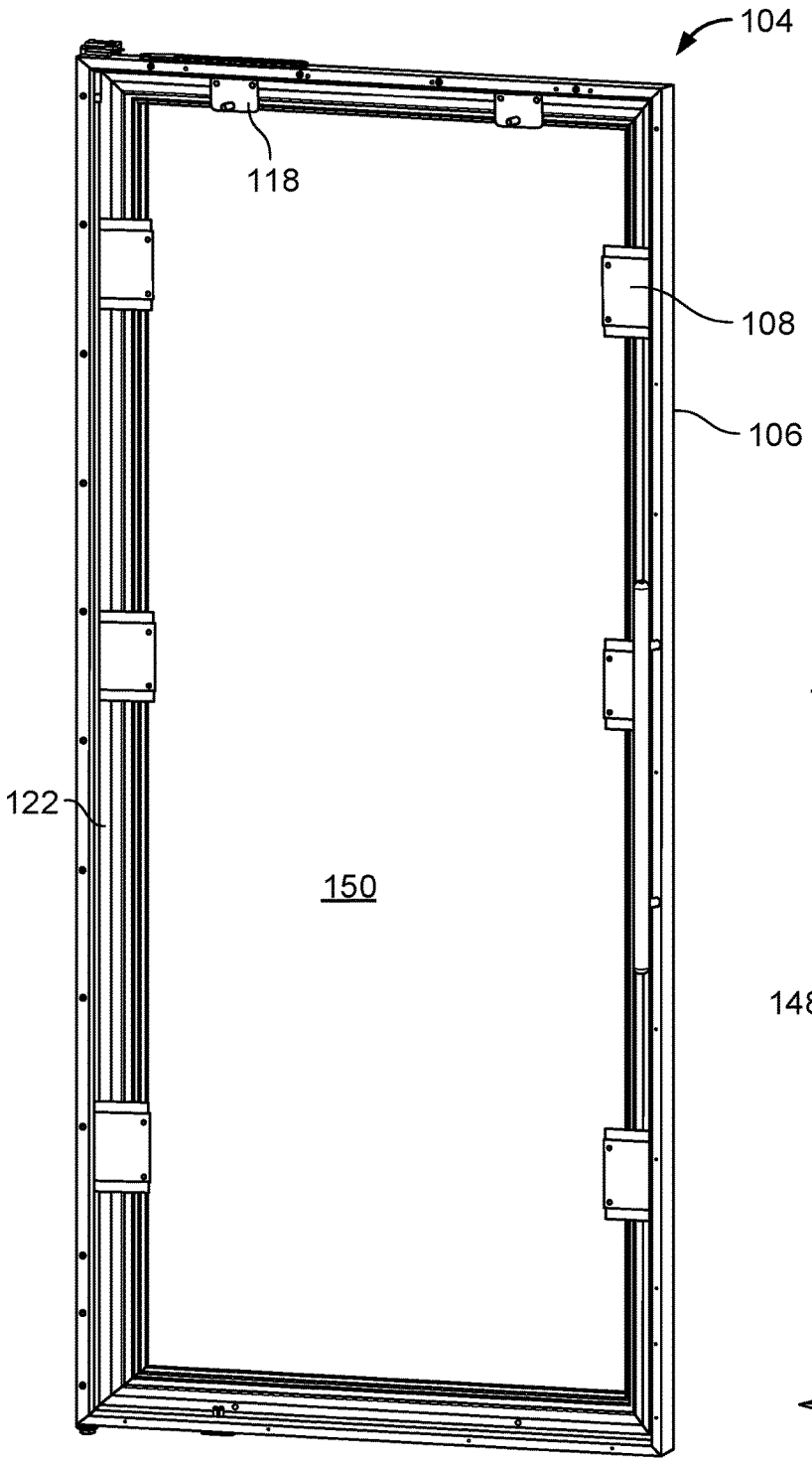
FIG. 4 is a perspective view illustrating a display case door with the electronic display assembly removed.
Figure 4A:
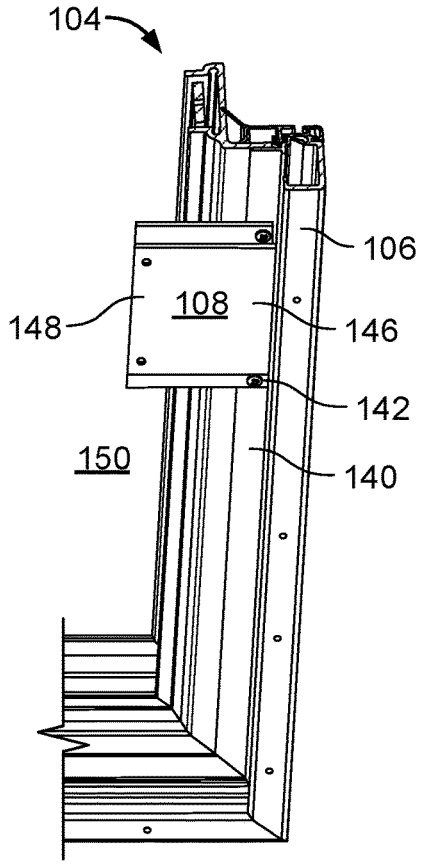
FIG. 4A is a perspective view of a portion of a door frame illustrating installation of a mounting block in a door frame.

FIG. 4 is a perspective view illustrating display case door 100 with electronic display assembly 102 removed. FIG. 4A is a perspective view of a portion of a door frame 106 illustrating one of mounting blocks 108. Mounting block 108 is secured to an inner rim 140 of door frame 106 by way of fasteners 142. Each of mounting blocks 108 extends inwardly from door frame 106. Mounting block 108 is secured to inner rim 140 of door frame 106 by way of fasteners 142 at an outer end 146 of mounting block 108. In some implementations, inner rim 140 includes internally threaded holes for receiving fasteners 142. The internally threaded holes can be in the form of threaded inserts installed at one or more locations on inner rim 140. In some implementations, the internally threaded holes are tapped holes in inner rim 140.

In the example shown in FIG. 4A, mounting block 108 extends inwardly from door frame 106 in front of insulated panel assembly 104. The inside end 148 of mounting block 108 can extend over the glass panels 150 of insulated panel assembly 104.

Figure 5:
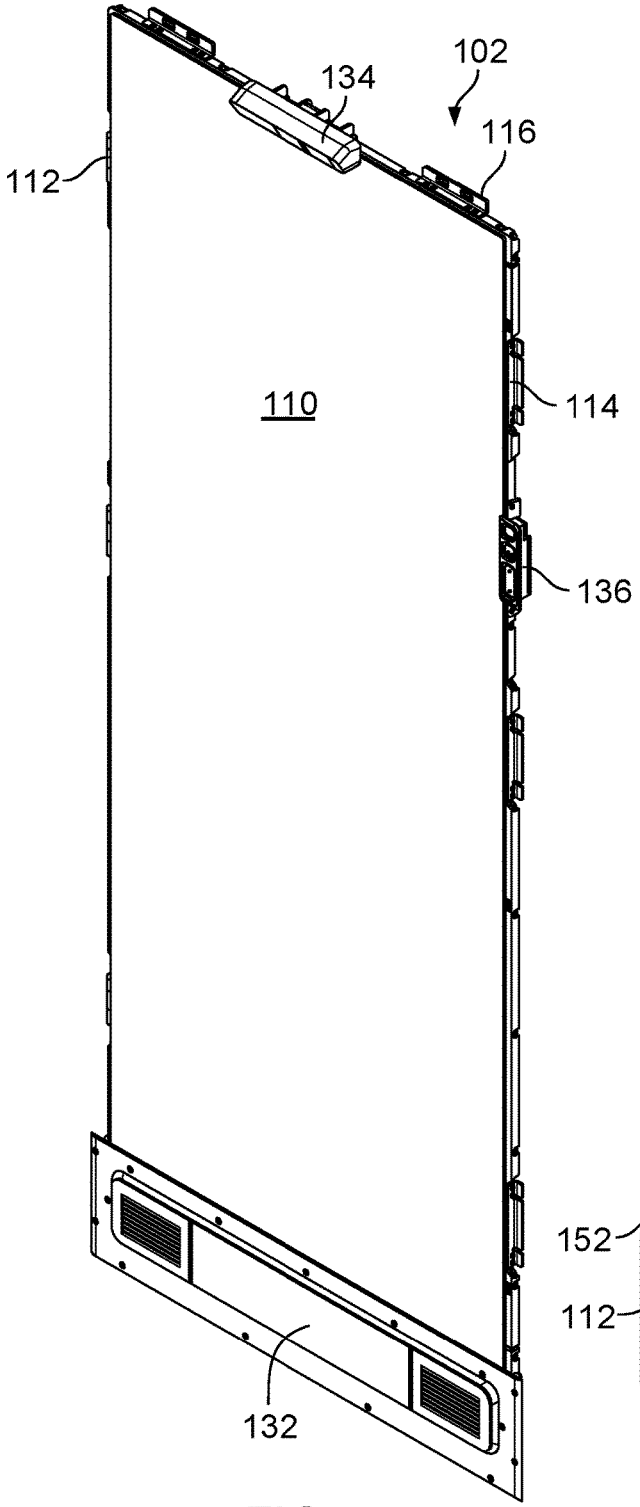
FIG. 5 is a perspective view of the electronic display assembly of FIG. 1.
Figure 5A:
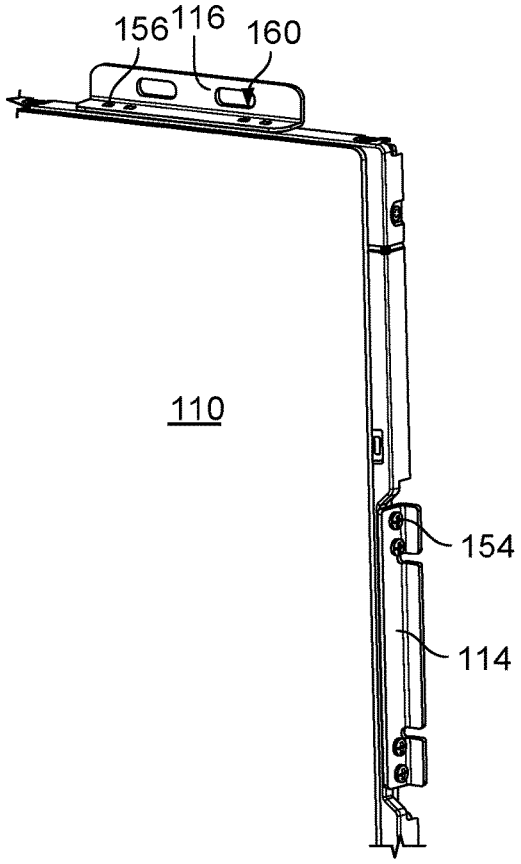
FIGS. 5A and 5B are perspective detail views of portions illustrating portions of the electronic display assembly.
Figure 5B:
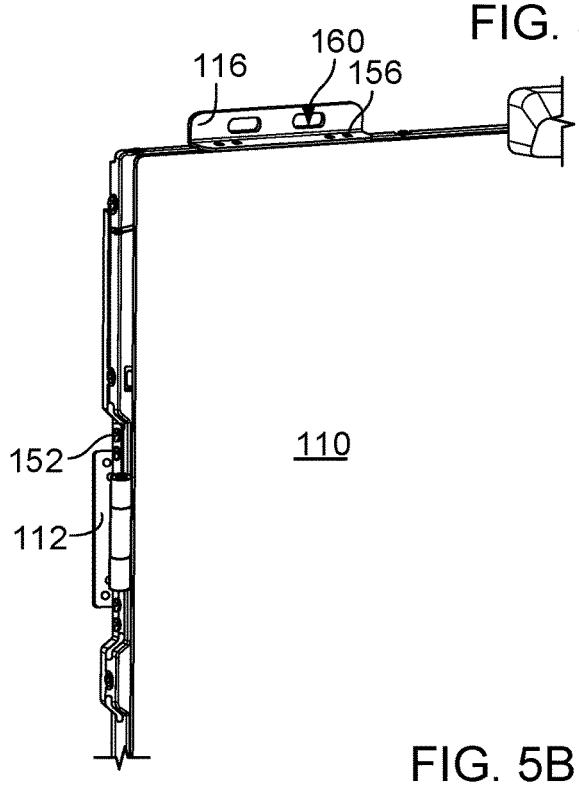

FIG. 5 is a perspective view of the electronic display assembly of FIG. 1. FIG. 5A is a perspective view of the upper right portion of the electronic display assembly. FIG. 5B is a perspective view of the upper left portion of the electronic display assembly. Left side hinge brackets 112 are attached to the left side of electronic display 110 by way of fasteners 152. Right side brackets 114 are attached to the right side of electronic display 110 by way of fasteners 154. Hangers 116 are attached to electronic display 110 by way of fasteners 156. Fasteners 152, 154, and 156 can be screws, bolts, rivets, or another type of fastener. Hangers 116 include slots 160.

Figure 6A:
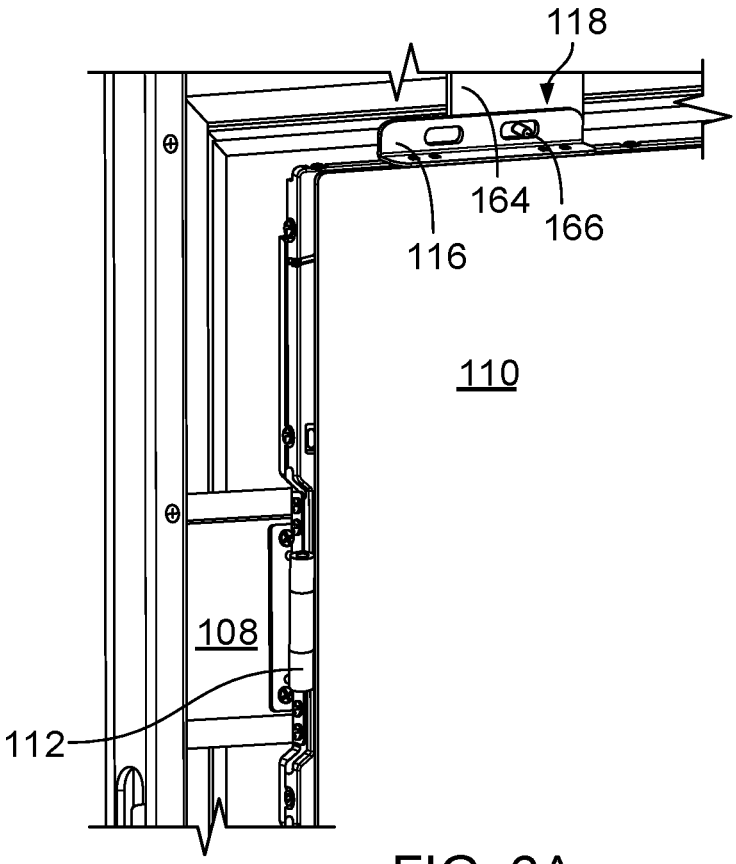
FIGS. 6A and 6B are perspective views of mounting of a left side hinge bracket.
Figure 6B:
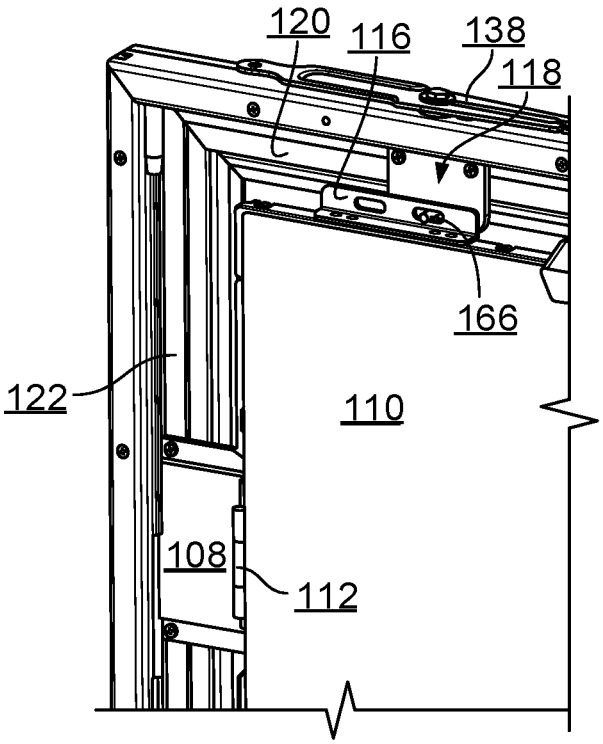

In some implementations, one or more of the mounting blocks serve as a spacer plate. The mounting blocks can define a position of the electronic display relative to a door frame. FIG. 6A is a perspective view of mounting of left side hinge bracket 112 on one of mounting blocks 108 looking inward toward electronic display 110. FIG. 6B is a perspective view of mounting of left side hinge bracket 112 on one of mounting blocks 108 looking outward toward door frame 106. Mounting block 108 is attached to inner rim 140 of insulated panel assembly 104 at outer end 146 of mounting block 108.

Thermal Shield

Figure 7:
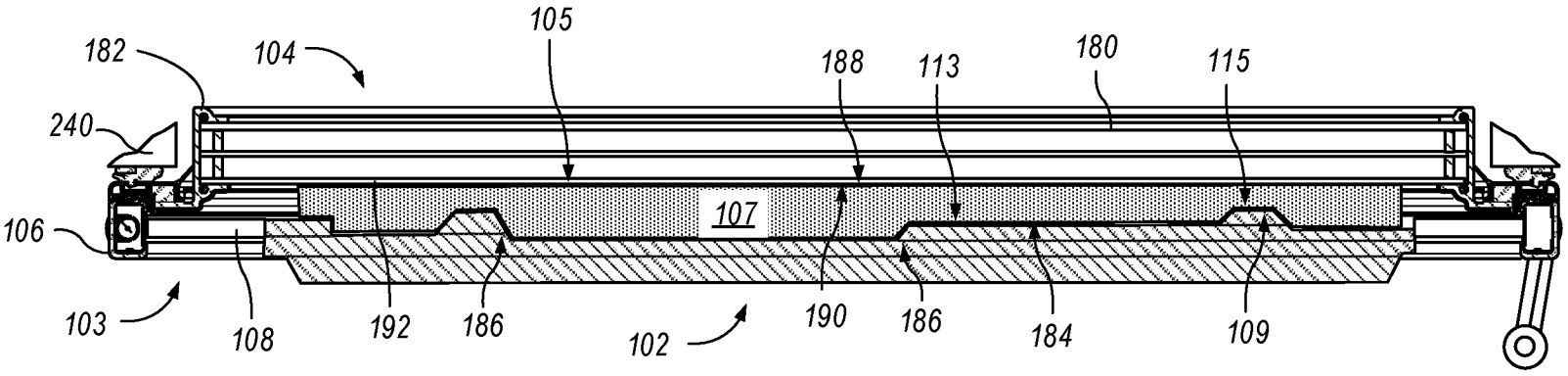
FIG. 7 is a top cross sectional view of a display door including a thermal shield.

FIG. 7 is a top cross sectional view of a display door including a thermal shield. Display door 100 includes electronic display assembly 102, door assembly 103, and thermal shield 105. Door assembly includes insulated panel assembly 104 and door frame 106. Insulated panel assembly 104 includes sealed glass unit 180 and SGU subframe 182. SGU subframe 182 includes a subframe rail on each of the left, right, top and bottom edges of sealed glass unit 180. As will be described in further detail below, a sealed glass unit can include two or more panes of glass separated from one another by spacers.

Barrier 107 of thermal shield 105 is positioned between electronic display assembly 102 and door assembly 103. Thermal shield 105 inhibits transfer of heat from heat producing components (e.g., a liquid crystal display screen) of electronic display assembly 102. Barrier 107 serves as a thermal break between the electronic display and sealed glass unit 180.

In this example, front surface 184 of barrier 107 includes contours 186. Contours 186 can include contours, such as recesses, ridges, holes, bumps, pockets, or grooves that follow the contours of features on the rear surface of electronic display assembly. Contours 186 of conform to corresponding features (e.g., ridges, cavities, etc.) of the rear surface 113 of electronic display assembly 102. For example, recess 109 of front surface 184 of barrier 107 matches the surface of ridge 115 of rear surface 113 of electronic display assembly 102 (also illustrated in FIG. 1B).

In this example, each of recesses 109 of barrier 107 can correspond to a complementary feature, such as a ridge, projection, or bump on the rear surface 113 of electronic display assembly 102. Conversely, front surface 184 of barrier 107 can include ridges, projections, or similar features that correspond to recesses, pockets, or similar features in the rear surface 113 of electronic display 102. Conformance between surface contours of barrier 107 and electronic display assembly 102 can increase the amount of thermally insulating material between the heat producing components of electronic display 102 and glass panes of insulated panel assembly 104.

Rear surface 188 of barrier 107 can be flat. Rear surface 188 contacts a front surface 190 of the forward-most pane of glass 192 of sealed glass unit 180.

Barrier 107 is made of a thermally insulating material, such as a thermally insulating foam. Barrier 107 can inhibit heat from heat-producing components of electronic display assembly 102 from passing into panes of glass of insulated panel assembly 104. Barrier 107 can prevent thermal gradients in the glass that cause damage to the sealed glass unit.

Barrier 107 can include one or more layers. At least one of the layers can be a thermally insulating material. In some implementations, a barrier is a sheet of closed cell foam, such as ethyl vinyl acetate (EVA). In one implementation, a barrier includes an inner layer and an outer layer. For example, the inner layer can be an EVA, and the outer layer can be polyethylene. Barrier 107 can be attached by way of an adhesive (e.g., pressure-sensitive adhesive on the rear surface of barrier 107 that can be applied to a front glass surface of SGU 180. In some examples, barrier 107 has a low moisture-vapor permeability.

In certain implementations, barrier 107 can include information on the rear surface of the barrier facing the glass, such as advertising.

In some implementations, barrier 107 is pre-molded. The molded front surface of the barrier can conform to at least some of the features of the rear surface with which the barrier will be placed in contact.

In some implementations, barrier 107 is made of a resilient material. The surface of the resilient material can conform contours on the rear surface 113 of electronic display assembly 102. In some implementations, barrier 107 is in compression between electronic display assembly 102 and insulated panel assembly 104 when the electronic display assembly 102 is installed on door assembly 103.

In some implementations, one or more of the panes of the glass include a coating. In one implementation, for example, at least one of the panes of insulated panel assembly 104 includes a thermally reflective coating (e.g., an infrared-reflective coating).

Figure 8:
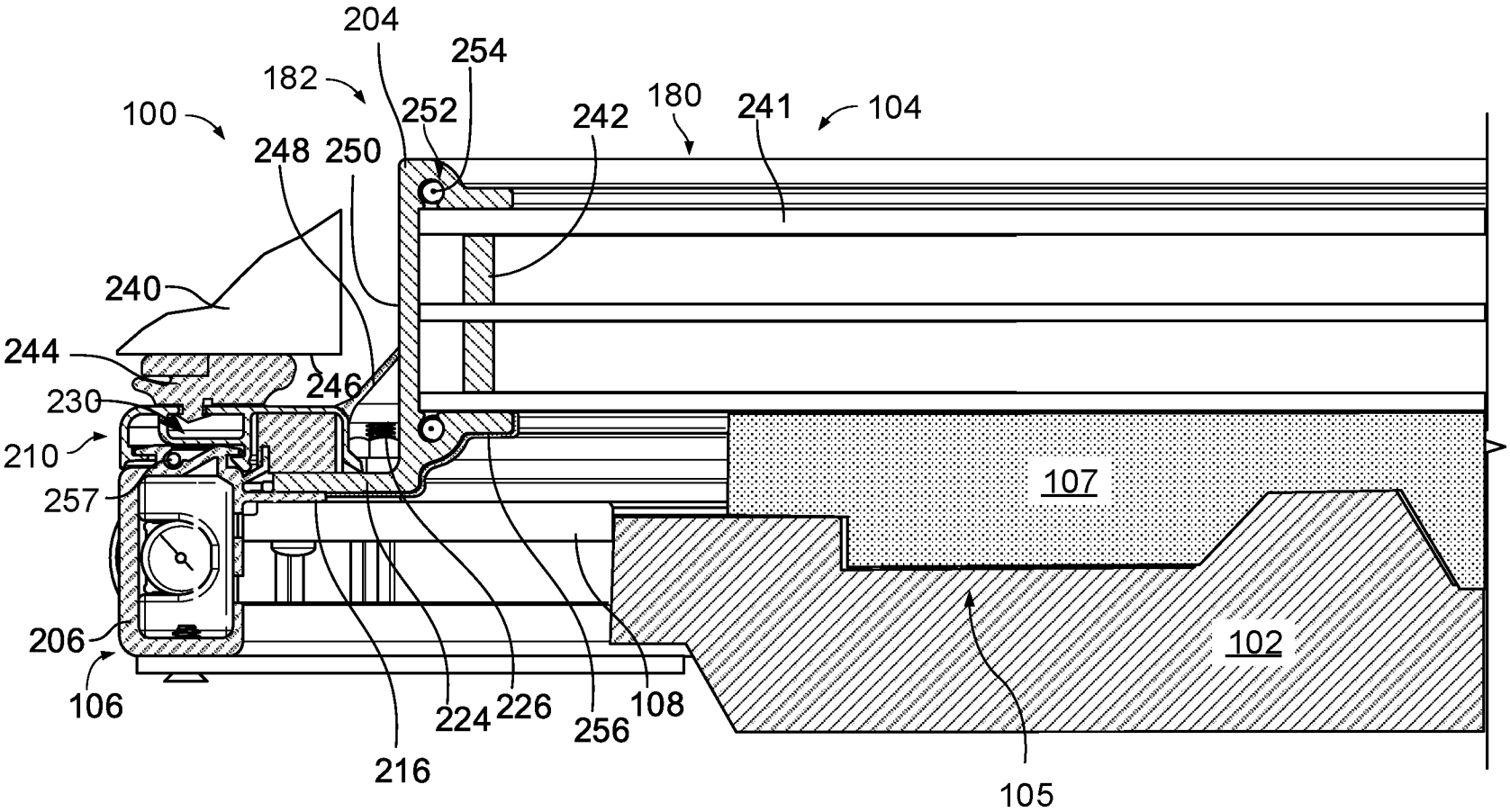
FIG. 8 is a cross sectional view of an installation of a display case door on a display case enclosure including a thermal shield.

FIG. 8 is a cross sectional view of an installation of a display case door on a display case enclosure including a thermal shield. Display case door 100 can be installed on display case enclosure 240. Display case door 100 can be mounted to display case enclosure 240 by way of a hinge system. In this case, display case door 100 can be swung open to access items in display case enclosure 240. In various implementations, a display case door includes features to reduce power consumption required to maintain surface temperatures above dew point.

Display case door 100 includes sealed glass unit assembly 104. Sealed glass unit assembly 104 is installed on door frame 106. In this example, front rim 224 of subframe rail 204 is contained between inner rim 216 of left rail 206 and the front face of back cover 210. In some implementations, subframe 204 is connected to left rail 206 by way of studs (for example, studs 226) and secured by way of a nuts installed on the studs.

Sealed glass unit 180 includes glass panes 2 and spacers 242. In the example shown in FIG. 8, sealed glass unit 180 includes three panes of glass. A sealed glass unit can nevertheless have, in other implementations, more or fewer than three panes of glass. In certain implementations, an insulated panel assembly is a vacuum insulated glass (VIG) assembly.

Back cover 210 is attached to left rail 206. Gasket 244 is installed in slot 230 of back cover 210. When display case door 100 is closed on display case enclosure 240, gasket 244 contacts sealing surface 246 of display case enclosure 240 to seal air in display case enclosure 240. In some implementations, sealing surface 246 is included on a frame installed in an opening in display case enclosure 240. Blade 248 of back cover 210 bears against an outer surface 250 of subframe rail 204. As will be further discussed below, blade 248 can serve as a thermal break for air in display case enclosure 240.

Sealed glass unit 180 can be at least partially recessed relative to the front of display case enclosure. In this example, two of the three panes 241 are to the rear of sealing surface 246 of display case enclosure 240.

Subframe rail 204 includes slots 252. Screws 254 can be installed in slots 252 to couple adjacent subframe rails 204 of SGU subframe 182 to secure SGU subframe 182 on sealed glass unit 180. Slots 252 can receive screws to join the miters of the subframe rail 204, which creates the SGU subframe 182.

In the example shown in FIG. 8, display case door 100 includes thermally conductive tape 256 on a front surface of subframe rail 204. As will be further described below, thermally conductive tape 256 can inhibit condensation on display case door 100. Heater wire 257 can be included between back cover 210 and left rail 206. In some implementations, sealed glass unit 180 includes one or more heater wires (omitted for clarity in FIG. 8).

To couple sealed glass unit assembly 104 to door frame 106, sealed glass unit assembly 104 can be dropped down on studs. In some implementations, butyl tape is applied all around the rail between each subframe rail 204 of subframe 182 and the corresponding rails of door frame 106. In certain implementations, other sealing materials can be used, such as polyurethane. In some implementations, an adhesive or two-sided tape can be used to join subframe rails to a corresponding rail of a door frame (instead of, or in addition to, mechanical fasteners such as screws, studs, or rivets).

Subframe rail 204 and left rail 206 can be coupled to one another by way of fasteners, such as screws or rivets. In one implementation, subframe rail 204 is attached using self-clinching studs. SGU assembly 104 is installed in the door frame by securing each of subframe rails 204 (left, right, top, and bottom) to a corresponding rail of door frame 106.

Figure 9:
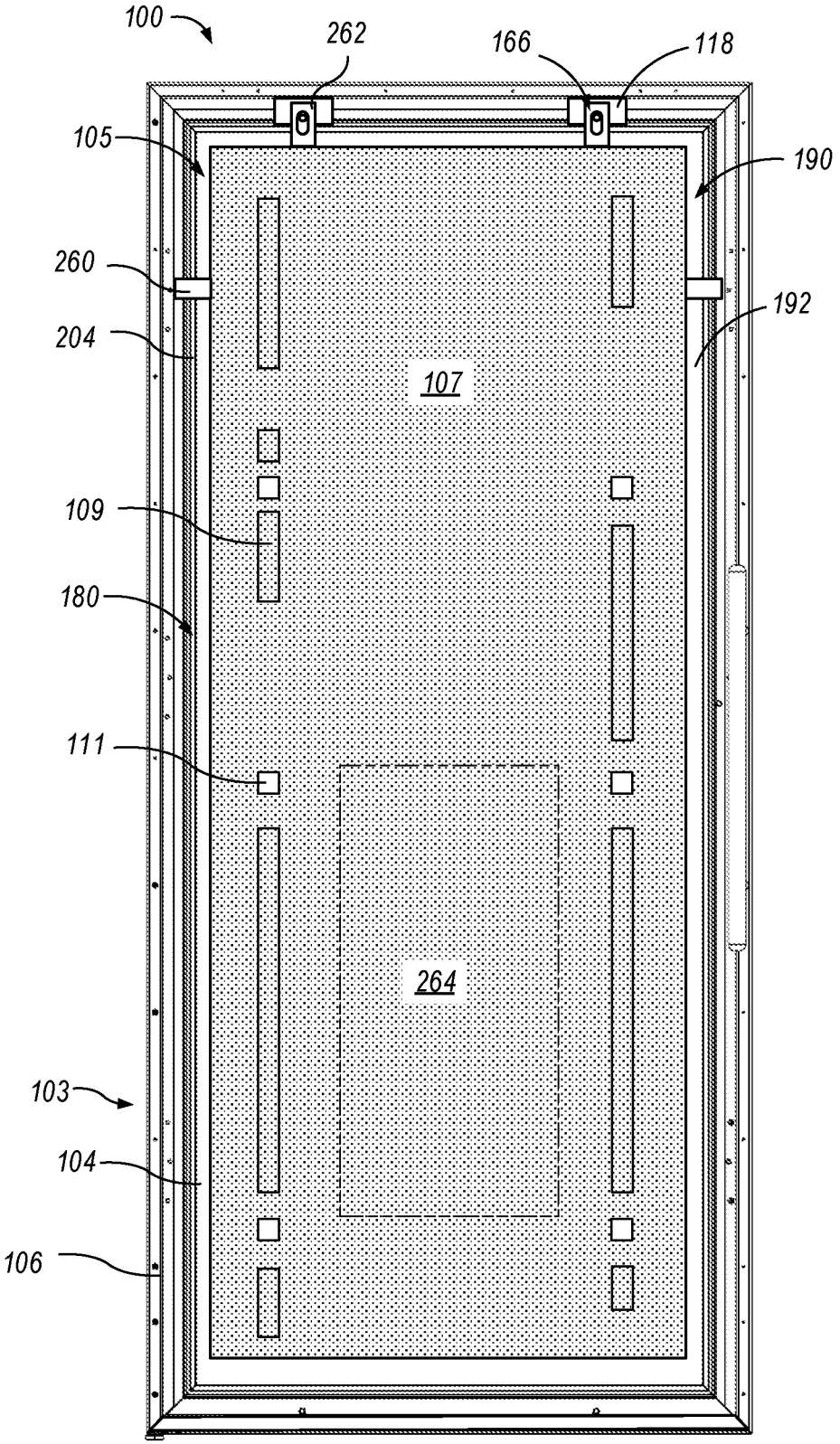
FIG. 9 is a front view of a display door including a thermal shield.

FIG. 9 is a front view of a display door including a thermal shield. For illustrative purposes, electronic display assembly 102 is omitted from FIG. 9. Display door 100 includes door assembly 103 and thermal shield 105. Door assembly 103 includes insulated panel assembly 104 and door frame 106. Insulated panel assembly 104 includes sealed glass unit 180. Thermal shield 105 can be positioned on the front surface 190 of the forward-most pane 192 of sealed glass unit 180.

In some implementations, thermal shield 105 includes one or more positioning members. For example, in FIG. 9, thermal shield includes side spacers 260 and top spacers 262. Positioning members can be used to locate barrier 107 relative to (e.g., relative to corresponding features on the rear surface of electronic display assembly 102.)

In the example shown in FIG. 9, side spacers 260 can control a horizontal position of barrier 107, and top spacers 262 can control a vertical position of barrier 107. In this example, top spacers 262 are co-located with display supports 118 for the electronic display assembly and the corresponding locating pins 166 on the display supports.

In some implementations, once barrier 107 is in position in front of insulated panel assembly 104, barrier 107 is fixed in place with respect to insulated panel assembly 104. In some implementations, barrier 107 is secured to a glass pane of insulated panel assembly 104 by way of an adhesive.

In one implementation, barrier 107 is enclosed in a frame that goes around the perimeter of the barrier. In this case, the frame can position the barrier in the door frame and hold the barrier in a desired position relative to the frame.

In some implementations, barrier 107 is held by friction against the electronic display assembly, the insulated panel assembly, or both (e.g., without any associated mounting hardware).

In some examples, some of the contours in the rear surface of the electronic display assembly correspond to rear-facing sensors of an electronic display. Apertures can be provided at the locations of the sensors so that objects to the rear of the insulated panel assembly 104 can be sensed through the panes of the insulated panel assembly. As shown in FIG. 9, for example, barrier 107 includes apertures 111. Although the apertures in this example are in-line with recesses 109, a thermal barrier can include apertures in other locations.

In some implementations, different sections or regions of a thermal shield have different thermal characteristics. For example, some regions of a thermal shield can be thicker, denser, or made of a better insulating material than other regions of the thermal shield. In some examples, region of the thermal shield with higher thermal insulation correspond to areas having heat producing components on an electronic display assembly. For example, region 264 shown in FIG. 9 may correspond to one or more high heat-producing components of the electronic display assembly (e.g., the location of an LCD display.)

In various implementations, there is a gap between the edges of a thermal barrier and the rails of the door frame in which it is installed. For example, in FIG. 9, the outer edge of barrier 107 stops short of the edge of inner rim of subframe rail 204. The gap runs the entire perimeter of barrier 107. In this case, heat from ambient air outside the display case and/or the edges of the electronic display assembly can pass (through the edges of door frame 106, through the air in the gaps, or both) into the outer portions of sealed glass unit 180. At the same time, excess heat from the center regions of electronic display assembly 102 can be shielded from the center regions of the panes of the sealed glass unit.

Although in various implementations described above, there is a gap between the outer edge of the barrier and the adjacent door rail, in certain implementations, there may be no gap between the edges of the barrier and some or all of the door rails. In one implementation, a barrier is formed (e.g., molded) to fill the entire space between a rear surface of an electronic display assembly and the front of a display door, including the space in front of the rim of the door rails that adjoins the forward-most pane of glass of the sealed glass unit.

Figure 10A:
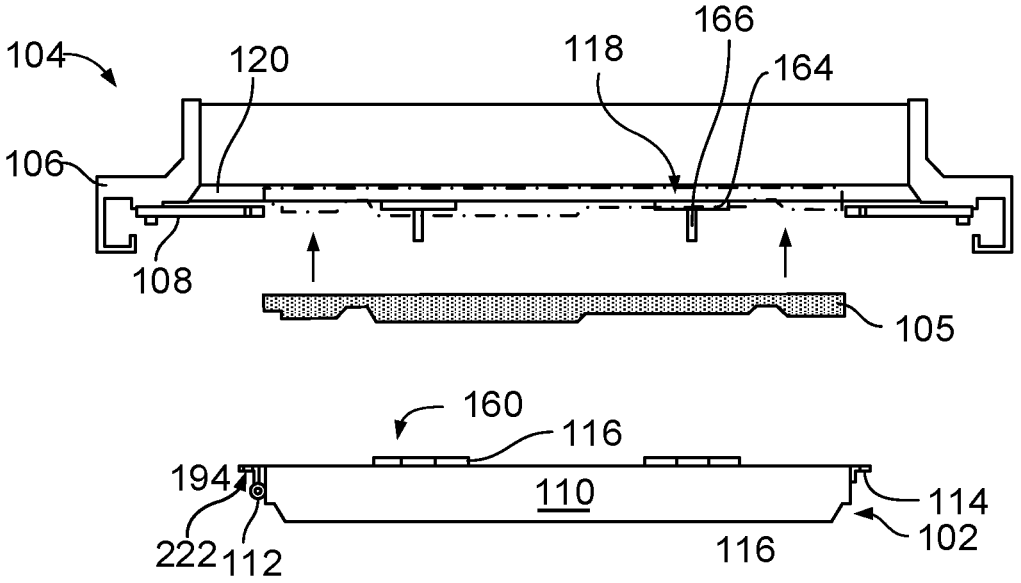
FIGS. 10A and 10B are schematic diagrams illustrating installation of a thermal shield and an electronic display assembly in a display case door.
Figure 10B:
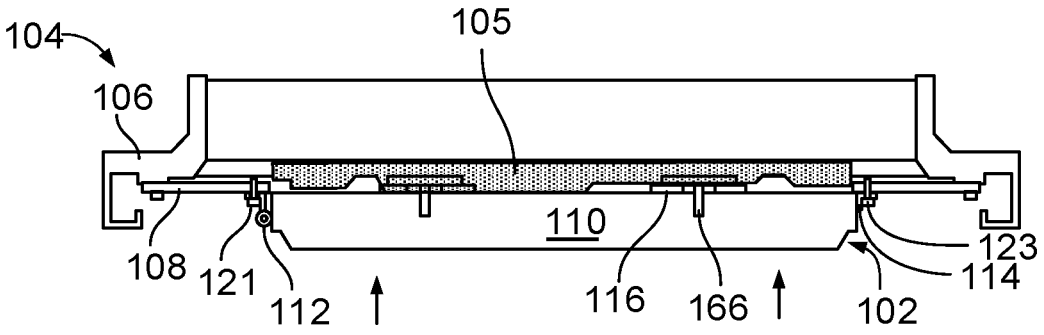

FIGS. 10A and 10B are schematic diagrams illustrating installation of a thermal shield and an electronic display assembly in a display case door. Referring to FIG. 10A, electronic display assembly 102 can be positioned in front of insulated panel assembly 104. Door frame 106 includes a pair of display supports 118 spaced across insulated panel assembly 104 and attached to top rail 120. Each of display supports 118 includes support bracket 164 and locating pin 166. In some examples, electronic display assembly 102 is lifted by one person or two persons into position such that slots 160 of hangers 116 are lined up with corresponding locating pins 166 on support brackets 164 attached to top rail 120 of door frame 106. Thermal shield 105 can be positioned in front of insulated panel assembly 104. In this example, thermal shield 105 can be attached to the forward-most pane of insulated panel assembly 104.

Referring to FIG. 10B, electronic display assembly 102 can be advanced rearwardly toward insulated panel assembly 104 (in the direction of the arrows) until locating pins 166 on support brackets 164 pass through slots 160 of hangers 116 on electronic display assembly 102. In this position, electronic display assembly 102 can be supported on locating pins 166. The lateral position of electronic display assembly 102 can be adjusted until mounting holes 222 of left side hinge brackets 112 align with threaded mounting holes 194 of mounting blocks 108 on the left side of door frame 106. Slots 160 in hangers 116 allow for lateral adjustment of electronic display 110. Once the lateral position of electronic display assembly 102 has been adjusted to align the mounting features of left side hinge brackets 112 of electronic display assembly 102 and the corresponding mounting features of mounting blocks 108, screws 121 and screws 123 can be installed to secure electronic display assembly 102 to door frame 106. Thermal shield 105 is held between held between electronic display assembly 102 and insulated panel assembly 104.

Figure 11A:
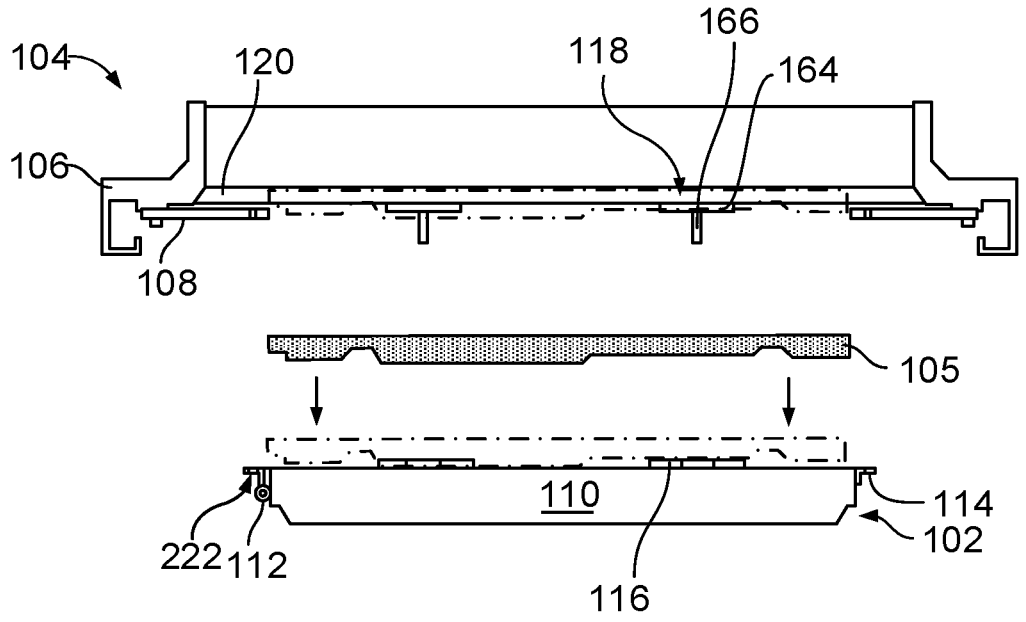
FIGS. 11A and 11B are schematic diagrams illustrating installation of a thermal barrier on the rear surface of an electronic display assembly before the electronic display is mounted on the door frame of a display door.
Figure 11B:
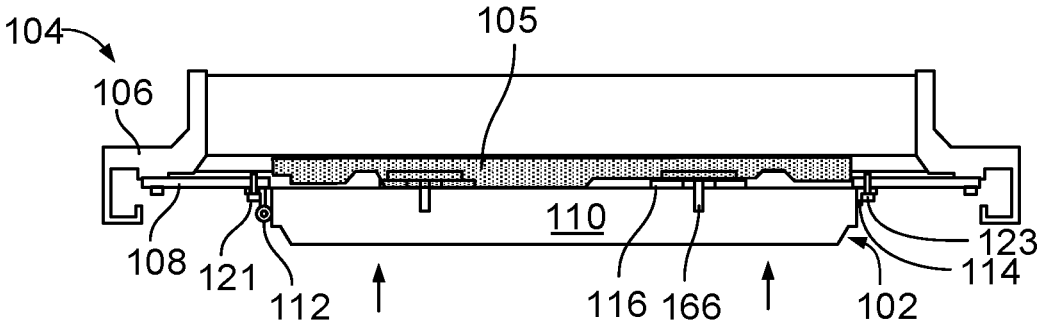

In some implementations described above with respect to FIGS. 9, 10A, and 10B, the thermal shield is mounted on the insulated panel assembly before installing the electronic display assembly. In some implementations, however, the thermal shield can be installed on the rear of the electronic display assembly before the electronic display assembly is mounted in the door frame. FIGS. 11A and 11B are schematic diagrams illustrating installation of a thermal barrier on the rear surface of an electronic display assembly before the electronic display is mounted on the door frame of a display door. In some implementations, the electronic display assembly, the thermal barrier, or both include complementary hardware for the thermal barrier to the electronic display assembly, such as hooks, pins, clips, or screws.

Figure 12:
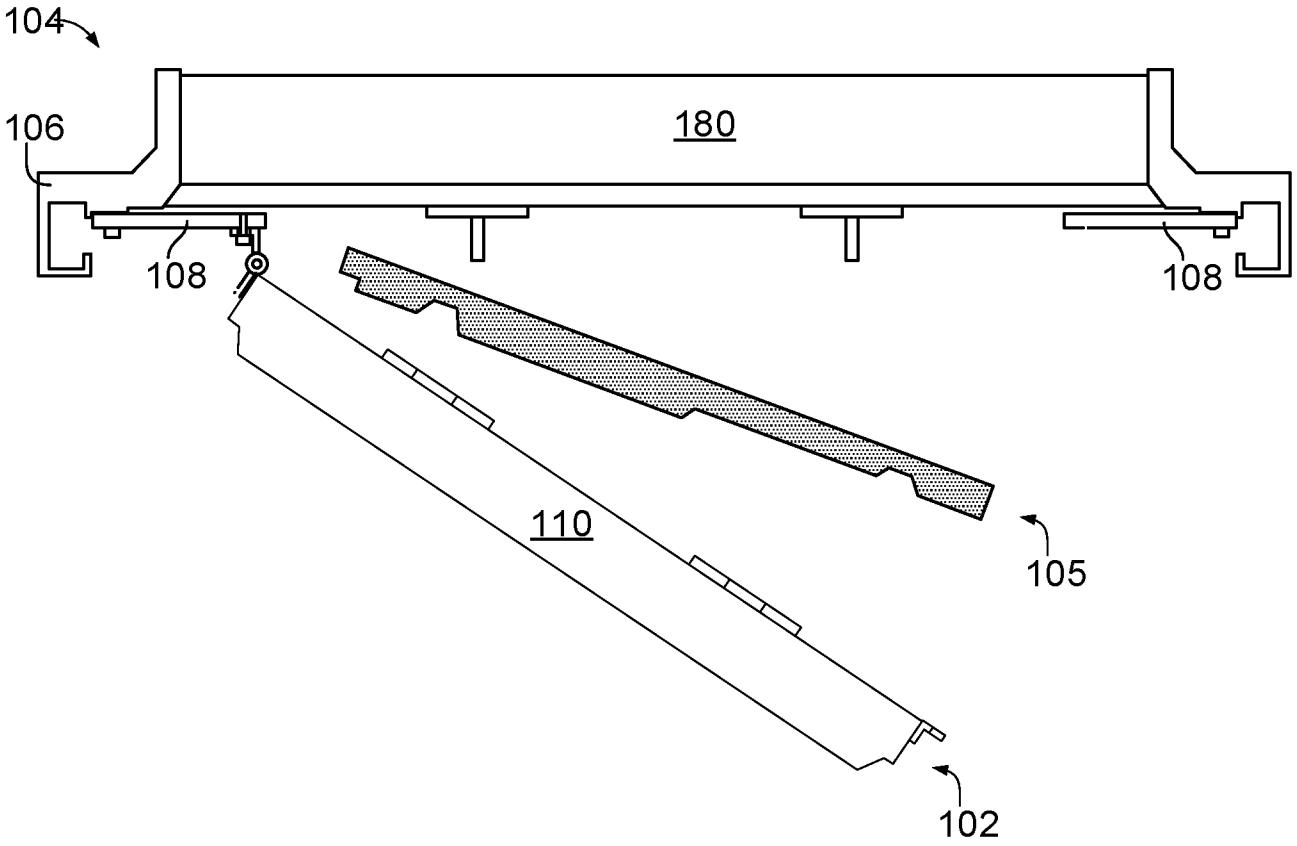
FIG. 12 illustrates swinging electronic display 110 away from insulated panel assembly 104.

In some implementations, electronic display assembly 102 can be swung on right left side brackets, away from glass panel 241 of insulated panel assembly 104 while display case door 100 (e.g., while display case door 100 is in service on a refrigeration system). Thermal shield 105 can be installed while electronic display assembly 102 is in the swung out position. FIG. 12 illustrates swinging electronic display 110 away from insulated panel assembly 104. Electronic display 110 is shown in the swung-out position. Swinging electronic display 110 out can allow maintenance personnel to access thermal shield 105 or other components on the rear side of electronic display 110 or the front side of insulated panel assembly 104.

Figure 13:
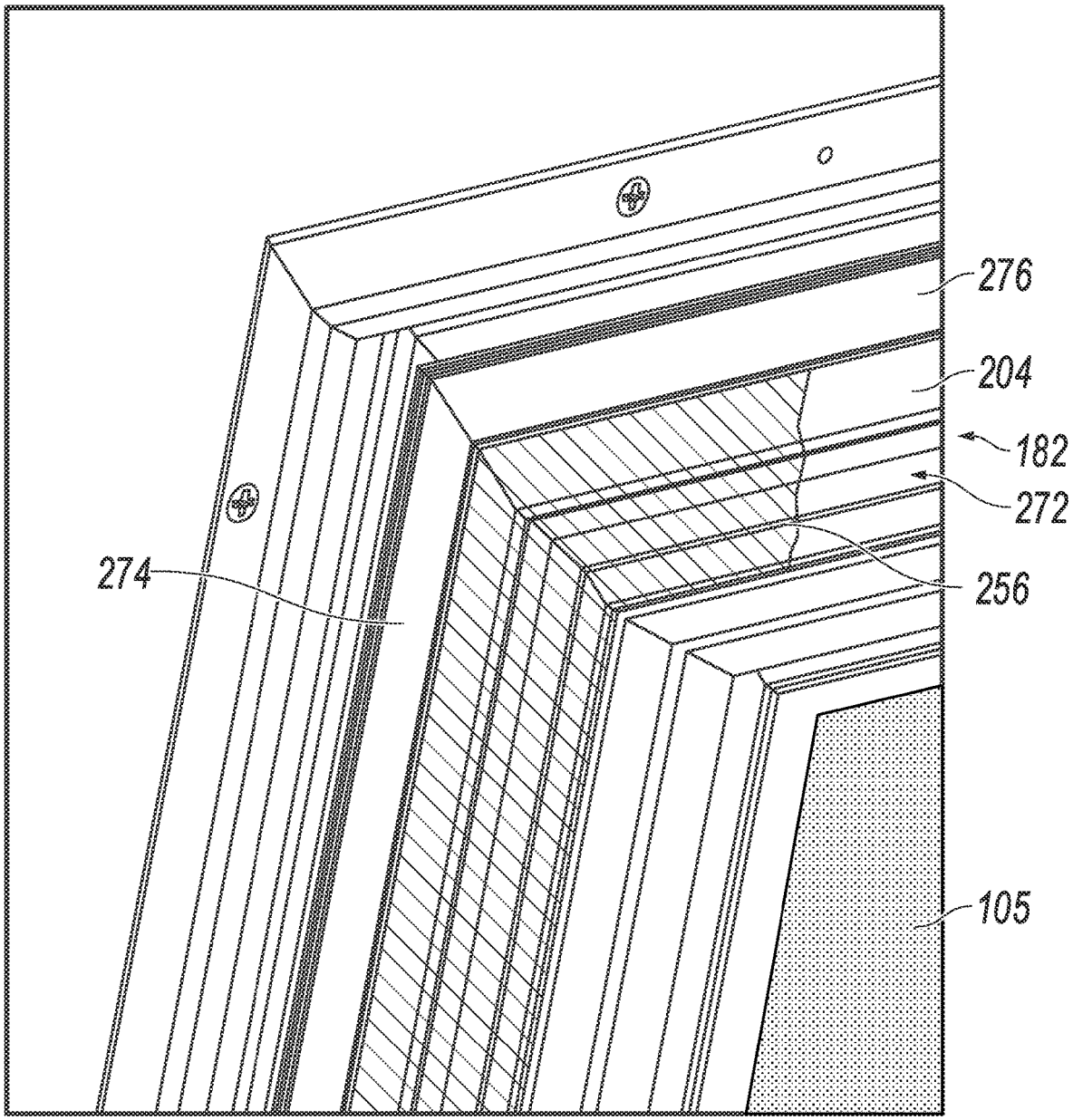
FIG. 13 illustrates a SGU assembly with a thermally conductive tape on a front surface of a subframe rail of the SGU assembly.

In certain implementations, a thermally conductive material is applied to a front surface of a subframe rail. FIG. 13 illustrates a SGU assembly with a thermally conductive tape on a front surface of a subframe rail of the SGU assembly. Thermally conductive tape 256 is installed on front surface 272 of subframe rail 204. Thermally conductive tape 256 can be installed on the front surface of a subframe around the entire perimeter of the subframe. Thermal shield 105 is in contact with the front surface of the glass. In the example shown in FIG. 13, the outer edge of the glass is spaced from the edge of the subframe rail.

Thermally conductive tape 256 can be in contact with the front edge of the adjacent rails of door frame 106. In some implementations, the rails of the door frame are made of an aluminum alloy or other thermally conductive material. In certain implementations, thermally conductive tape can be applied over a portion of a front rail of the door frame. Thus, in this example, an outer edge of thermally conductive tape 256 can be applied on side rail 274 and top rail 276.

As illustrated in FIG. 13, thermally conductive tape 256 can be applied up to the edge of the front glass pane of sealed glass unit 180. Thus, the tape can cover the entire exposed front surface of subframe 182. In other implementations, a thermally conductive material covers only a portion of the exposed front surface of a subframe.

In one implementation, thermally conductive tape 256 is an aluminum tape with a thermally conductive adhesive. In another implementation, thermally conductive tape 256 is a copper tape with a thermally conductive adhesive. Other examples of thermally conductive materials include acrylic tape, or a thermally conductive coating, such as a thermally conductive epoxy. In certain implementations, a surface rail is covered with a tape that includes a closed cell PVC foam of light density with a PVC backing, with an acrylic adhesive on one side.

In various implementations above, a thermal shield includes a single barrier between the electronic display assembly and the panes of glass of the insulated panel assembly. A thermal shield can, however, in other implementations include two or more barriers. For example, a thermal shield can include two or more barriers in layers (e.g., in a stack of two or more sheets of thermally insulating material). As another example, a thermal shield can include two or more barriers arranged across the surface of an SGU and/or electronic display, such as tiles, strips, or patches.

Visual Barrier

Figure 14:
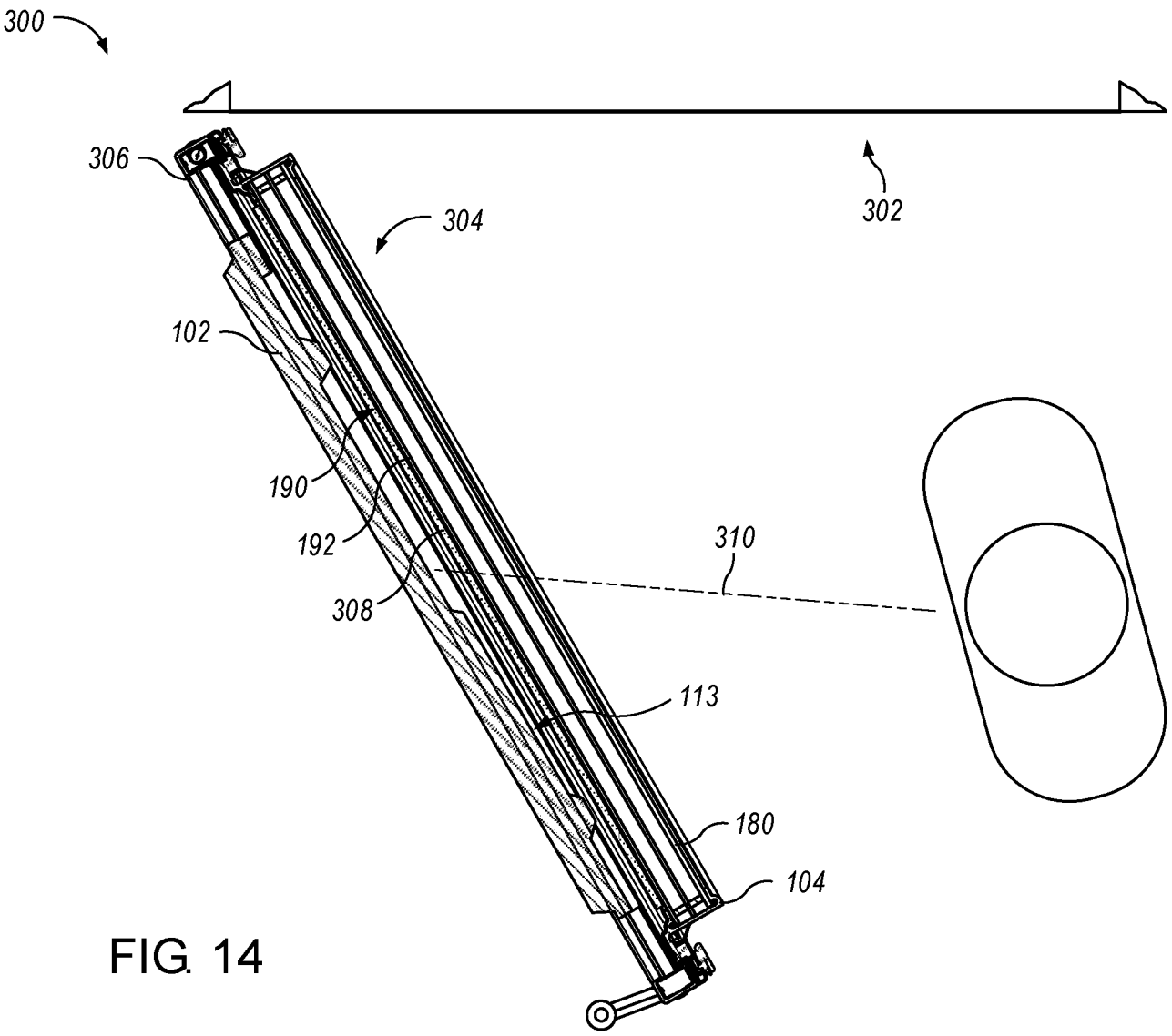
FIG. 14 is a schematic top view of a display case illustrating a cover on an inside surface of an insulated panel assembly.

FIG. 14 is a schematic top view of a display case illustrating a cover on an inside surface of an insulated panel assembly. The cover serves as a visual barrier for users looking through the panes of an insulated panel assembly from the inside of a display door. Display case 300 includes enclosure 302 and display case door 304. Display case door 304 includes door assembly 306 and electronic display assembly 102. Door assembly 306 can be similar to door assembly 103 described above relative to FIGS. 1-12. Insulated panel assembly 104 includes sealed glass unit 180. Cover 308 is installed on a front surface 190 of forward-most pane 192 of sealed glass unit 180 (shown in FIG. 7).

In various implementations, cover 308 is opaque or translucent. In one implementation, cover 308 is black. Cover 308 provides a visual barrier for a user looking through the panes of insulated panel assembly 104 at the rear surface 113 of electronic display assembly 102 (along, for example, line of sight 310.) Cover 308 can block all or a portion of the user's view of the rear surface of electronic display assembly 102, which may be aesthetically unappealing. In certain implementations, cover 308 can include information on the rear surface of the cover, such as advertising.

Figure 15:
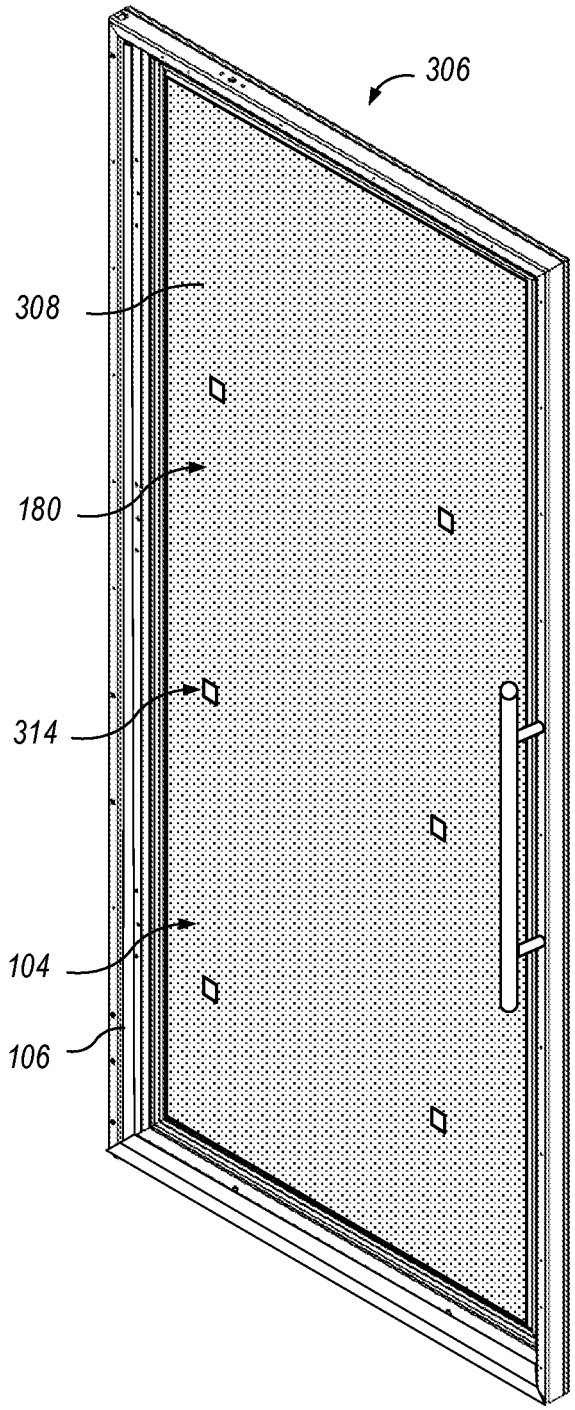
FIG. 15 is a perspective view illustrating cover 308 on the forward-most pane of insulated panel assembly 104.

FIG. 15 is a perspective view illustrating cover 308 on the forward-most pane of insulated panel assembly 104. Door assembly 306 includes insulated panel assembly 104 and door frame 106. Cover 308 is attached to the front surface 190 of the forward-most pane 192 of sealed glass unit 180 of insulated panel assembly 104. In some implementations, cover 308 is a sheet of static cling film. In this example, cover 308 extends across the entire exposed surface of the pane. A cover can nevertheless, in some implementations, cover only a portion of the pane (for example, the top half of the glass.)

Cover 308 includes apertures 314. Each of apertures 314 can provide a window through which one or more sensors 119 (shown in FIG. 1B) on electronic display assembly 102 can sense objects on the rear of insulated panel assembly 104.

Figure 16:
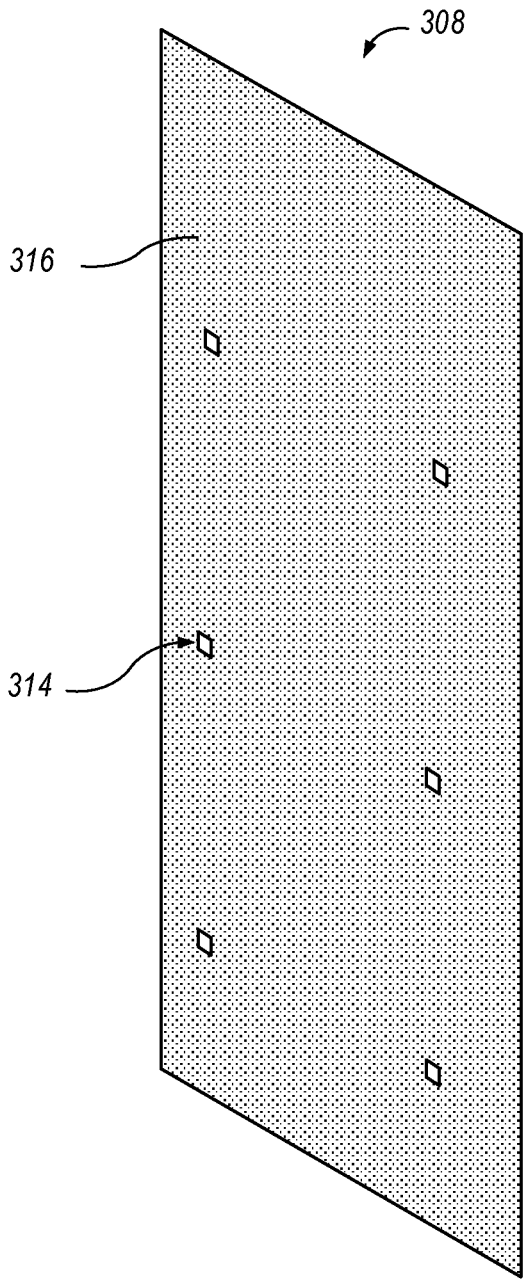
FIG. 16 is a perspective view of a cover including sensor apertures.

FIG. 16 is a perspective view of a cover. Cover 308 includes film 316. Film 316 may be a static cling film. In one example, film 316 is made of PVC. In one example, film 316 is about 8 mil.

Film 316 can be opaque or translucent. In certain implementations, film 316 is transparent. One or more opaque or translucent coating can be applied to the film.

Apertures 314 can be made (e.g., punched, machined, or drilled) in film 316. Apertures 314 can be symmetric about the centerline of film 316. In this manner, cover 308 may be reversible. In one implementation, apertures 314 are about 0.49×0.49 inches square.

In the example shown in FIG. 16, apertures 314 are shown as square. Apertures in a cover can, however, be other shapes, including circular, rectangular, oval or irregular.

Figure 17:
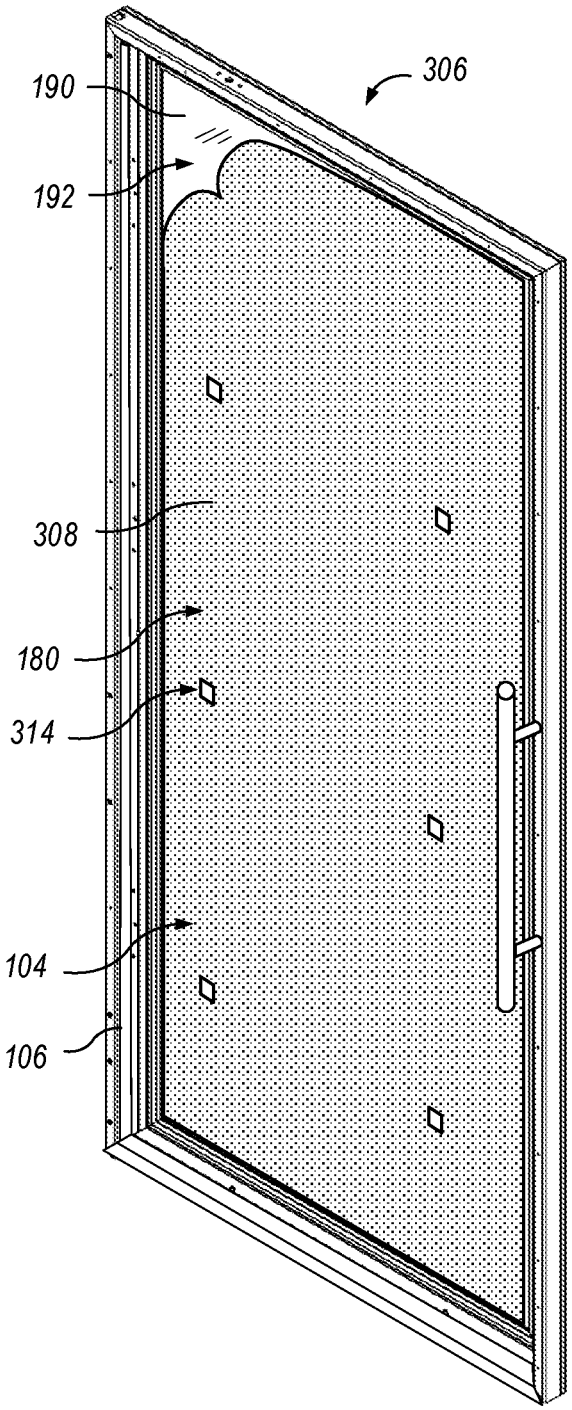
FIG. 17 illustrates removal of a film cover.

In some implementations, cover 308 is removable from an insulated panel assembly. FIG. 17 illustrates removal of a film cover. In this example, cover 308 is removed by peeling cover 308 away from front surface 190 of forward-most pane 192.

In some examples, a display door is placed back into service once the cover has been removed. For example, the display door might be placed back in service without an electronic display on the display door. In some examples, cover 308 is reinstalled on the insulated panel assembly.

Cover 308 can be self-attaching. For example, cover 308 may not require any separate fastening hardware to install on a glass surface. In some implementations, as noted above, cover 308 can be a sheet of static cling film. In certain implementations, cover 308 includes a pressure-sensitive adhesive. In other implementations, cover 308 includes separate components for the mounting the film or sheet, such as a frame, clips, or threaded fasteners.

In certain implementations, a display case door includes a both a thermal shield and a visual barrier between a front surface of an insulated panel assembly and the rear surface of an electronic display assembly. In one implementation, the visual barrier and the thermal shield are combined into one component. In other implementations, the visual barrier and the thermal barrier are separate components. For example, display door 100 can include a thermal barrier 105 such as described relative to FIGS. 1A and 1B, and a cover 308 as described relative to FIG. 15.

While a number of examples have been described for illustration purposes, the foregoing description is not intended to limit the scope of the invention, which is defined by the scope of the appended claims. There are and will be other examples and modifications within the scope of the following claims. Furthermore, one of skill in the art would appreciate that features described in reference to a specific embodiment are not limited to that embodiment and can be interchanged with features of other embodiments.

What is claimed is:

1. A display case door, comprising:

an insulated panel assembly comprising one or more panes and defining a front surface and a rear surface;

a door frame coupled to the insulated panel assembly;

an electronic display assembly coupled to the door frame in front of the insulated panel assembly, the electronic display assembly comprising a rear surface;

one or more thermal barriers disposed between the rear surface of the electronic display assembly and the front surface of the insulated panel assembly, wherein at least one thermal barrier of the one or more thermal barriers comprise a region with different thermal characteristics than other areas of the at least one thermal barrier, the region with different thermal characteristics positioned to correspond to heat-producing components of the electronic display assembly; and a plurality of positioning members extending between the door frame and the one or more thermal barriers, the plurality of positioning members locating the one or more thermal barriers relative the electronic display assembly, wherein an outer edge of at least one thermal barrier of the one or more thermal barriers defines an air gap between the at least one thermal barrier and at least one rail of the door frame, and wherein the plurality of positioning members span the air gap between the at least one rail of the door frame and the at least one thermal barrier.

2. The display case door of claim 1, wherein at least one of the one or more thermal barriers is configured to inhibit heat transfer from one or more heat producing components of the electronic display assembly to the one or more panes of the insulated panel assembly.

3. A method of protecting an insulated panel assembly in a display case door from thermal damage, comprising:

positioning a thermal barrier on or adjacent to at least one of a front surface of panes of the insulated panel assembly and a rear surface of an electronic display assembly to be installed in front of the insulated panel assembly by installing the thermal barrier in a space between the front surface of the insulated panel assembly and the rear surface of the electronic display assembly;

positioning the thermal barrier relative to the insulated panel assembly and the electronic display assembly using a plurality of positioning members extending between a door frame of the insulated panel assembly and the thermal barrier, wherein an outer edge of the thermal barrier and at least one rail of the door frame defines an air gap between the thermal barrier and the insulated panel assembly, the plurality of positioning members spanning the air gap between the at least one rail of the door frame and the thermal barrier;

coupling a front surface of the thermal barrier to the rear surface of the electronic display assembly such that a shape of the front surface of the thermal barrier conforms to contours in the rear surface of the electronic display assembly; and positioning the electronic display assembly relative to the electronic display assembly such that the thermal barrier is between the front surface of one of the panes of the insulated panel assembly and a rear surface of the electronic display assembly and such that the thermal barrier inhibits transfer of heat from heat producing components in the electronic display assembly.

4. The display case door of claim 1, wherein at least one of the one or more thermal barriers contacts at least a portion of a front surface of the insulated panel assembly and at least a portion of the rear surface of the electronic display assembly.

5. The display case door of claim 1, wherein at least one of the one or more thermal barriers is held in place between at least a portion of the front surface of at least one pane of the one or more panes and at least a portion of the rear surface of the electronic display assembly.

6. The display case door of claim 1, wherein:

the rear surface of the electronic display assembly defines one or more contours, a front surface at least one of the one or more thermal barriers defines one or more contours, and the front surface of at least one of the one or more thermal barriers is configured to at least partially conform to at least a portion of the rear surface of the electronic display assembly.

7. The display case door of claim 1, wherein:

at least one of the one or more thermal barriers comprises a resilient material, and at least a portion of at least one of the one or more thermal barriers is in compression between the rear surface of the electronic display assembly and the front surface of the insulated panel assembly.

8. The display case door of claim 1, wherein at least one thermal barrier of the one or more thermal barriers comprises a foam.

9. The display case door of claim 1, wherein at least one thermal barrier of the one or more thermal barriers comprises ethyl vinyl acetate (EVA).

10. The display case door of claim 1, wherein at least a portion of the rear surface of at least one of the one or more thermal barriers comprises an information display.

11. The display case door of claim 1, wherein the insulated panel assembly comprises two or more rails, wherein the display case door further comprises a thermally conductive material on a front surface of at least one rail of the two or more rails.

12. The display case door of claim 1, wherein at least a portion of at least one thermal barrier of the one or more thermal barriers contacts at least one of a rail of the door frame.

13. The display case door of claim 1, wherein at least one of the one or more thermal barriers is configured to conceal at least a portion of the rear surface of the electronic display assembly from a user looking through the one or more panes from the rear of the insulated panel assembly.

14. The display case door of claim 1, further comprising one or more covers configured to conceal at least a portion of the rear surface of the electronic display assembly from a user looking through the one or more panes from the rear surface of the insulated panel assembly.

15. The display case door of claim 14, wherein at least one of the one or more covers is self-attaching to the front surface of the panes.

16. The display case door of claim 14, wherein the at least one of the one or more covers comprises a static cling film.

17. The display case door of claim 1, wherein the one or more thermal barriers comprise:

a thermally insulating portion, the thermally insulating portion defined by at least a rear surface configured to couple with a front surface of a pane of the insulated panel assembly and a front surface configured to couple with a rear surface of the electronic display assembly; and one or more apertures extending through the thermally insulating portion from the front surface to the rear surface of the thermally insulating portion, the one or more apertures corresponding to locations of one or more of rear-facing sensors on the rear surface of the electronic display assembly.

18. The display case door of claim 1, wherein the plurality of positioning members comprise:

at least one top spacer extending vertically from a top rail of the door frame to the one or more thermal barriers; and at least one side spacer extending from a side rail of the door frame to the one or more thermal barriers.

19. A display case door for a refrigerated enclosure, the display case door comprising:

an insulated panel assembly;

an electronic display assembly comprising rear-facing sensors facing the insulated panel assembly; and a thermal barrier comprising:

a thermally insulating portion, the thermally insulating portion defined by at least a rear surface configured to couple with a front surface of a pane of the insulated panel assembly and a front surface configured to couple with a rear surface of the electronic display assembly; and one or more apertures extending through the thermally insulating portion from the front surface to the rear surface of the thermally insulating portion, the one or more apertures corresponding to locations of one or more of the rear-facing sensors.

20. The display case door of claim 19, wherein the front surface comprises one or more contours configured to at least partially conform to the rear surface of the electronic display assembly.

21. The display case door of claim 19, wherein the front surface is pre-molded to at least partially conform to the rear surface of the electronic display assembly.

22. The display case door of claim 19, wherein the thermally insulating portion comprises a resilient material configured to conform to one or more contours on the rear surface of the electronic display assembly.

23. The display case door of claim 19, wherein comprising an adhesive configured to couple the thermally insulating portion to the pane of the insulated panel assembly.

24. The display case door of claim 19, wherein the thermally insulating portion comprises a foam.

25. The method of claim 3, wherein the thermal barrier is held between the front surface of panes of the insulated panel assembly and the electronic display assembly.

26. The method of claim 3, wherein positioning the electronic display assembly comprises swinging on a hinge of a door frame holding the insulated panel assembly such that the electronic display assembly is in front of the insulated panel assembly.

27. The method of claim 3, wherein at least a portion of the thermal barrier is compressed between the front surface of panes of the insulated panel assembly and the electronic display assembly.

28. The method of claim 3, wherein at least a portion of the rear surface of the electronic display assembly and at least a portion of a front surface of the thermal barrier are complementary to one another, the method further comprising coupling complementary surfaces of the thermal barrier and the electronic display assembly.

* * * * *